US006068967A

United States Patent [19]

Suzuki et al.

[11] Patent Number: 6,068,967

[45] Date of Patent: May 30, 2000

[54] SILVER HALIDE PHOTOGRAPHIC MATERIAL

[75] Inventors: Keiichi Suzuki; Tomokazu Yasuda, both of Kanagawa, Japan

[73] Assignee: Fuji Photo Film Co., Ltd., Kanagawa, Japan

[21] Appl. No.: 08/772,516

[22] Filed: Dec. 24, 1996

[30] Foreign Application Priority Data

Dec. 26, 1995 [JP] Japan ..... 7-350753

[51] Int. Cl.[7] ..... B03C 1/815; G03C 1/825

[52] U.S. Cl. ..... 430/510; 430/517; 430/522; 430/631; 430/627; 430/531

[58] Field of Search ..... 430/510, 517, 430/522, 631, 627, 531

[56] References Cited

U.S. PATENT DOCUMENTS

| | | | |
|---|---|---|---|
| 3,362,821 | 1/1968 | Land | 430/372 |
| 5,468,598 | 11/1995 | Miller et al. | 430/372 |
| 5,714,307 | 2/1998 | Harada et al. | 430/517 |

*Primary Examiner*—Geraldine Letscher
*Attorney, Agent, or Firm*—Sughrue, Mion, Zinn, Macpeak & Seas, PLLC

[57] ABSTRACT

A silver halide photographic material is disclosed which comprises a support having provided thereon at least one light-sensitive silver halide emulsion layer, wherein at least one photographic layer in the photographic material contains a high molecular weight compound having a repeating unit represented by formula (I) and a solid fine particle dispersion of a dye:

(I)

wherein $R_1$ represents a hydrogen atom or an alkyl group; $R_2$ represents a hydrogen atom, an alkyl group or an aryl group; $R_3$ and $R_4$ each represents a hydrogen atom or an alkyl group; and $M_1$ and $M_2$ each represents a hydrogen atom or a cation.

7 Claims, No Drawings

SILVER HALIDE PHOTOGRAPHIC MATERIAL

FIELD OF THE INVENTION

The present invention relates to a silver halide photographic material.

BACKGROUND OF THE INVENTION

In a silver halide photographic material, photographic emulsion layers or other layers are often colored for the purpose of absorbing a light of a specific wavelength. A colored layer is provided on the side farther than emulsion layer(s) from the support for controlling the incident amount of light of photographic emulsion layers. Further, for preventing halation, a colored layer is provided between the emulsion layer and the support or on the side of the support opposite to the side on which emulsion layers are provided. In the case of a multilayer color photographic material, such a colored layer may be provided intermediately. In an X-ray photographic material, in some case, a colored layer is provided as a crossover-cut filter for reducing crossover light. An emulsion layer may be colored for the prevention of irradiation caused by light scattering in an emulsion layer. Moreover, for adjusting the tint of a photographic material after being development processed or investing detectability for various optical sensors, any of the layers can be colored.

Dispersion of solid dyes which satisfy these conditions described above are known such as those disclosed in JP-A-56-12639 (the term "JP-A" as used herein means an "unexamined published Japanese patent application"), JP-A-55-155350, JP-A-55-155351, JP-A-52-92716, JP-A-63-197943, JP-A-63-27838, JP-A-64-40827, EP-B-15601, EP-A-276566 and WO 88/4794. These dispersions can be prepared easily using dispersing aids and it is known that they can prevent precipitation and agglomeration of dyes after dispersion during storage. Sodium alkylphenoxyethoxyethylenesulfonates and alkylnaphthalenesulfonate are well known as specific examples thereof.

A method capable of finely graining a dye slurry of the highest possible concentration within a limited range of time is indispensable for effectively dispersing a dye. However, fine grain dispersion is difficult to obtain within a limited time with the conventionally known dispersing aids, sometimes rough grains remain, or sufficient absorbance cannot be obtained, that is, the width of absorbance is broad. Further, when a dye becomes a solid of fine grains, as is thought probably due to the solubilization of the dispersing aid which is used, the diffusibility (fixing capability) of the dispersion in a photographic material is deteriorated and the fixing capability of the dye is deteriorated. There is also another problem such that when foams are liable to be generated, grains are often hardly dispersed because of the creamy foams. From the above, a dispersion having satisfactory absorbance while maintaining sufficient fixing capability has been desired.

It has been desired in recent years to use dyes which are substantially not removed from the photographic material by the processing solution (hereinafter referred to as "non-dissolving out dyes"), for the reduction of replenishing rate of processing solutions and rapid processing. In particular, a dye dispersion having sufficient absorbance and fixing capability satisfying detectability for various optical sensors as well has been desired. However, it has been difficult to obtain a dispersion having satisfactory properties with the conventionally used dispersing aids.

SUMMARY OF THE INVENTION

One object of the present invention is to provide a silver halide photographic material in which only a desired hydrophilic colloid layer is selectively colored.

Another object of the present invention is to provide a silver halide photographic material which contains a solid dispersion of a dye having high absorbance.

The above objects of the present invention have been achieved by the following means.

(1) A silver halide photographic material comprising a support having provided thereon at least one light-sensitive silver halide emulsion layer, wherein at least one photographic layer in the photographic material contains a high molecular weight compound having a repeating unit represented by formula (I) and a solid fine particle dispersion of a dye:

(I)

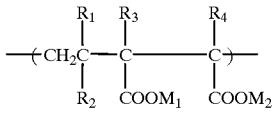

wherein $R_1$ represents a hydrogen atom or an alkyl group; $R_2$ represents a hydrogen atom, an alkyl group or an aryl group; $R_3$ and $R_4$ each represents a hydrogen atom or an alkyl group; and $M_1$ and $M_2$ each represents a hydrogen atom or a cation.

(2) The silver halide photographic material as described in (1), wherein said solid fine particle dispersion of a dye is dispersed using said high molecular weight compound having a repeating unit represented by formula (I).

(3) The silver halide photographic material as described in (1) or (2), wherein in formula (I) $R_1$ represents a hydrogen atom or an alkyl group having from 1 to 3 carbon atoms; $R_2$ represents a hydrogen atom, an alkyl group having from 1 to 30 carbon atoms or an aryl group having from 6 to 36 carbon atoms; $R_3$ and $R_4$ each represents a hydrogen atom or an alkyl group having from 1 to 3 carbon atoms; and $M_1$ and $M_2$ each represents a hydrogen atom or an alkali metal ion.

(4) The silver halide photographic material as described in any one of from (1) to (3), wherein said solid fine particle dispersion of a dye is a solid fine particle dispersion of a dye represented by formula (FA):

$$D\text{-}(X)_y \qquad \text{(FA)}$$

wherein D represents a compound having a chromophore; X represents an ionizable proton bonded directly or via a divalent linking group to D, or a group having an ionizable proton; and y represents an integer of from 1 to 7.

(5) The silver halide photographic material as described in (4), wherein the solid fine particle dispersion of the dye represented by formula (FA) is a solid fine particle dispersion of-a dye represented by formula (FA1), (FA2) or (FA3):

$$A^1=L^1-(L^2=L^3)_m-Q \qquad \text{(FA1)}$$

$$A^1=L^1-(L^2=L^3)_n-A^2 \qquad \text{(FA2)}$$

$$A^1=(L^1-L^2)_n=B^1 \qquad \text{(FA3)}$$

wherein $A^1$ and $A^2$ each represents an acid nucleus; $B^1$ represents a basic nucleus; Q represents an aryl group or a heterocyclic group; $L^1$, $L^2$ and $L^3$ each represents a methine group; m represents 0, 1 or 2; and n represents 0, 1, 2 or 3; provided that the compound represented by formula (FA1), (FA2) or (FA3) contains, in one molecule, at least one group selected from the group consisting of a carboxylic acid group, a sulfonamido group, an arylsulfamoyl group, a sulfonylcarbamoyl group, a carbonylsulfamoyl group, an enol group of an oxonol dye, and a phenolic hydroxyl group and does not contain a water-soluble group other than the above.

(6) The silver halide photographic material as described in any one of from (1) to (3), wherein said solid fine particle dispersion of a dye is a solid fine particle dispersion of a dye represented by formula (F1) or (F2):

$$A^3=L_a-A^4 \quad \text{(F1)}$$

$$B^2=L_b-B^3(X^-)_{k-1} \quad \text{(F2)}$$

wherein $A^3$ and $A^4$ each represents an acid nucleus; $B^2$ represents a basic nucleus; $B^3$ represents an onium form of a basic nucleus; $L_a$ and $L_b$ each represents a linking group formed by bonding 5, 7, 9 or 11 methine groups with conjugated double bonds; $X^-$ represents an anion; and k represents 2 or 1, and when the dye forms an inner salt, k represents 1.

DETAILED DESCRIPTION OF THE INVENTION

The present invention is described in detail below.

First of all, a high molecular weight compound having a repeating unit represented by formula (I) for use in the present invention is described.

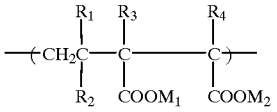

(I)

wherein $R_1$ represents a hydrogen atom or a substituted or unsubstituted alkyl group (preferably an alkyl group having from 1 to 3 carbon atoms), preferably represents a hydrogen atom, a methyl group, or an ethyl group, and particularly preferably a hydrogen atom or a methyl group.

$R_2$ represents a hydrogen atom, a substituted or unsubstituted alkyl group (preferably an alkyl group having from 1 to 30 carbon atoms, e.g., methyl, ethyl, n-propyl, isopropyl, n-butyl, isobutyl, tert-butyl, n-pentyl, neopentyl, tert-pentyl, n-hexyl, cyclohexyl, n-octyl, 2-ethylhexyl, n-decyl, n-dodecyl, cetyl, octadecyl, docosyl), or a substituted or unsubstituted aryl group (preferably an aryl group having from 6 to 36 carbon atoms, e.g., phenyl, naphthyl, anthranyl). Functional groups to be introduced as substituents are not particularly limited and examples thereof include, for example, an alkyl group (e.g., methyl, ethyl), an aryl group (e.g., phenyl, naphthyl, anthranyl), a hydroxyl group, a halogen atom, a cyano group, a carboxyl group, a sulfo group, a phosphoryl group, an alkoxyl group (e.g., methoxy, ethoxy, n-hexyloxy, dodecyloxy, 2-phenylethoxy), an acyl group (e.g., acetyl, propionyl), an amino group, and a polyoxyalkylene group (e.g., polyoxyethylene, polyoxypropylene, polyglycidyl). Two or more functional groups may be present at the same time. $R_2$ preferably represents a substituted or unsubstituted alkyl group having from 2 to 22 carbon atoms or a substituted or unsubstituted aryl group having from 6 to 10 carbon atoms, and most preferably a substituted or unsubstituted alkyl group having from 4 to 10 carbon atoms (e.g., n-butyl, tert-butyl, tert-amyl, n-hexyl, n-octyl, decyl) or a phenyl group.

$R_3$ and $R_4$ each independently represents a hydrogen atom or an alkyl group, preferably a hydrogen atom or an alkyl group having from 1 to 3 carbon atoms (e.g., methyl, ethyl, n-propyl, isopropyl), and particularly preferably a hydrogen atom or a methyl group.

$M_1$ and $M_2$ each independently represents a hydrogen atom or a cation, preferably a hydrogen atom or an alkali metal ion (e.g., sodium ion, potassium ion, cesium ion), and particularly preferably a hydrogen atom, a sodium ion or a potassium ion.

The high molecular weight compound having a repeating unit represented by formula (I) of the present invention may have other repeating units which are introducible by copolymerization with other vinyl monomers other than the repeating unit represented by formula (I), or may have a plurality of different repeating units.

There is no particular limitation on the monomer having a vinyl group capable of providing an introducible repeating unit, and specific examples which can be preferably used in the present invention include acrylic esters (e.g., methyl acrylate, ethyl acrylate, n-propyl acrylate, isopropyl acrylate, n-butyl acrylate, tert-butyl acrylate, amyl acrylate, n-hexyl acrylate, cyclohexyl acrylate, n-octyl acrylate, 2-ethylhexyl acrylate, dodecyl acrylate, 2-chlorooctyl acrylate, 2-hydroxyethyl acrylate, 2-cyanoethyl acrylate, 3-methoxypropyl acrylate, 2-acetoxyethyl acrylate, 2-N,N-dimethylaminoethyl acrylate, benzyl acrylate, furfuryl acrylate, tetrahydrofurfuryl acrylate, phenyl acrylate, ω-methoxypolyethylene glycol acrylate (addition mol number n of polyethylene glycol=23), and ω-methoxypolypropylene glycol acrylate (addition mol number n of polyethylene glycol=9)), methacrylic esters (methacrylic esters having the same alcohol based ester structures as acrylic ester monomers shown above), acrylamides (e.g., acrylamide, N-methylacrylamide, N-ethylacrylamide, N-n-propylacrylamide, N-isopropylacrylamide, N-n-butylacrylamide, N-tert-butylacrylamide, N-cyclohexylacrylamide, N-tert-octylacrylamide, N-phenylacrylamide, N,N-dimethylacrylamide, N,N-dibutylacrylamide, diacetonacrylamide, N-(2-acetoacetoxyethylacrylamide), 2-hydroxyethylacrylamide), methacrylamides (methacrylamides having the same alcohol based ester structures as acrylamide monomers shown above), olefins (e.g., ethylene, propylene, 1-butene, 2-butene, isoprene, vinyl chloride, vinylidene chloride, chloroprene, 2,3-dimethylbutadiene), styrenes (styrene, methylstyrene, dimethylstyrene, ethylstyrene, isopropylstyrene, methoxystyrene, acetoxystyrene, chlorostyrene, dichlorostyrene, chloromethylstyrene, hydroxymethylstyrene, methyl vinylbenzoate), vinyl ethers (methyl vinyl ether, butyl vinyl ether, hexyl vinyl ether, methoxyethyl vinyl ether, N,N-dimethylaminoethyl ether), unsaturated carboxylic acid esters or amides (butyl crotonate, hexyl crotonate, dibutyl itaconate, diethyl maleate, dibutyl maleate, diethyl fumarate, N,N'-dimethylmaleic acid amide, N,N,N',N'-tetramethylmaleic acid amide, N-octyl maleic acid amide), vinyl ketones (methyl vinyl ketone, methoxyethyl vinyl ketone), N-vinyl compounds (N-vinyloxazolidone, N-vinylpyrrolidone), acrylonitrile, and methacrylonitrile.

Examples of monomers having an acid group which are preferably used in the present invention include acrylic acid, methacrylic acid, itaconic acid, maleic acid, monoalkyl itaconate (e.g., monomethyl itaconate, monoethyl itaconate), maleic acid monoester (e.g., monomethyl maleate, monoethyl maleate), citraconic acid, vinylbenzoic acid, styrenesulfonic acid, vinylsulfonic acid, acryloyloxyalkylsulfonic acid (e.g., acryloyloxyethylsulfonic acid, acryloyloxybutylsulfonic acid), methacryloyloxyalkylsulfonic acid (methacryloyloxyethylsulfonic acid, methacryloyloxybutylsulfonic acid), acrylamidoalkylsulfonic acid (e.g., 2-acrylamido-2-methylethanesulfonic acid, 2-acrylamido-2-methylpropanesulfonic acid), methacrylamidoalkylsulfonic acid (e.g., 2-methacrylamido-2-methylpropanesulfonic acid, 2-methacrylamido-2-methylbutanesulfonic acid) and salts of these compounds.

Further, the monomers having a vinyl group capable of providing a repeating unit introducible to the high molecular weight compound of the present invention are also preferably used in admixture of two or more.

The weight-average molecular weight of the high molecular weight compound having a repeating unit represented by formula (I) for use in the present invention is not particularly limited but is preferably from 1,000 to 3,000,000, particularly preferably from 2,000 to 1,000,000.

The compounds disclosed in U.S. Pat. Nos. 3,362,821, 4,902,612, British Patent 1,380,165, German Patent 2,460,677 and JP-A-1-216340 are preferably used in the present invention as the high molecular weight compound having a repeating unit represented by formula (I).

The high molecular weight compound having a repeating unit represented by formula (I) for use in the present invention can be easily synthesized, in general, by copolymerization by the combination of corresponding vinyl monomers, and details are disclosed, for example, in U.S. Pat. No. 3,362,821. A compound having a trade name of "Demol" is commercially available from Kao K.K. as such a high molecular weight compound.

Specific examples of the high molecular weight compound having a repeating unit represented by formula (I) for use in the present invention are shown below, but the present invention is not limited thereto.

WP-1

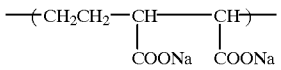

Mw = 8600

WP-2

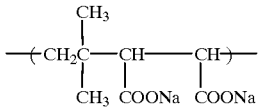

Mw = 11500

WP-3

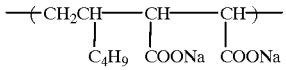

Mw = 12000

WP-4

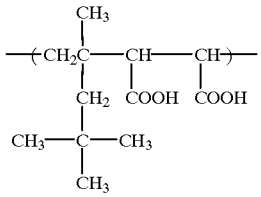

Mw = 9200

WP-5

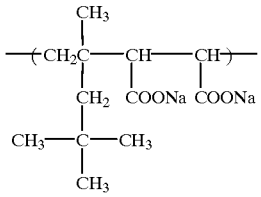

Mw = 14300

WP-6

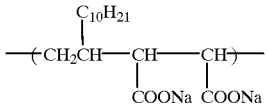

Mw = 10500

-continued

WP-7

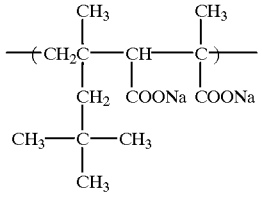

Mw = 7200

WP-8

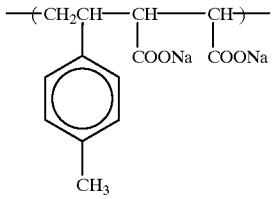

Mw = 20100

WP-9

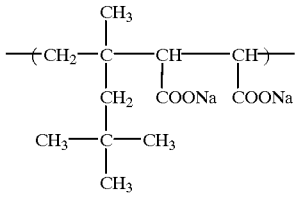

Mw = 31000

WP-10

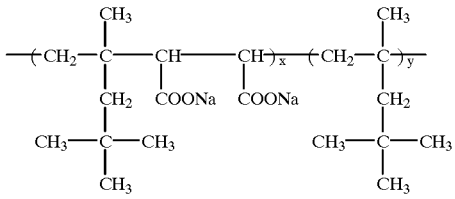

x/y = 80/20 (mol ratio)
Mw = 12100

WP-11

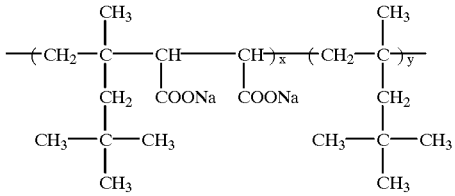

x/y = 60/40 (mol ratio)
Mw = 8100

WP-12

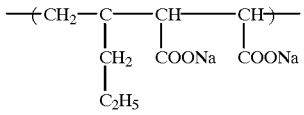

Mw = 6400

-continued

WP-13

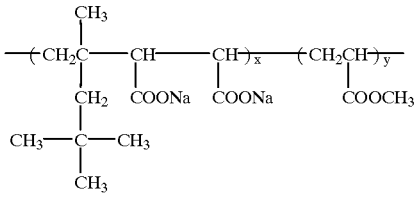

$x/y$ = 70/30 (mol ratio)
Mw = 15900

WP-14

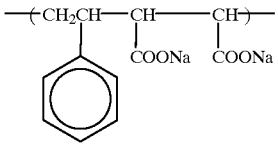

Mw = 20400

WP-15

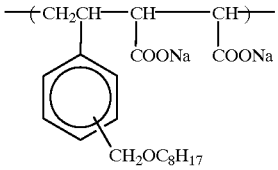

Mw = 11300

WP-16

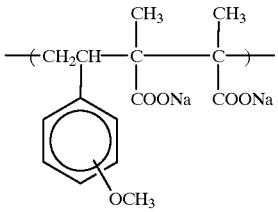

Mw = 7900

WP-17

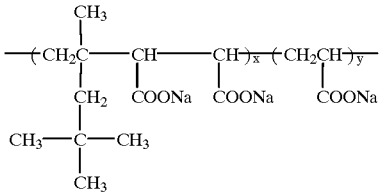

$x/y$ = 90/10 (mol ratio)
Mw = 14100

WP-18

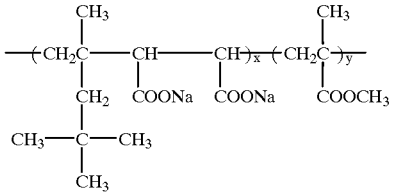

$x/y$ = 70/30 (mol ratio)
Mw = 11100

-continued

WP-19

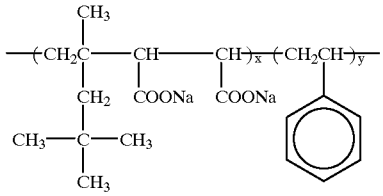

$x/y$ = 95/5 (mol ratio)
Mw = 8900

WP-20

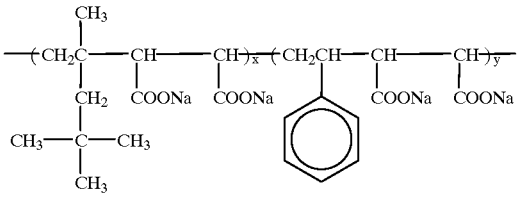

$x/y$ = 50/50 (mol ratio)
Mw = 12300

When the high molecular weight compound having a repeating unit represented by formula (I) is used as a dispersing aid of the dyes described below, it is preferably used in the range of from 1 to 100%, more preferably from 5 to 50%, by weight based on the solid content of the dye. However, these ranges do not apply to the case when the compound is necessary to be added additionally after dispersion for dilution for preparing the solution and the like.

A solid fine particle dispersion of the dye for use in the present invention is described in detail below.

Known dyes or pigments, for example, those disclosed in *Senryo Benran* (*Handbook of Dyes*), edited by Yuki Gosei Kagaku Kyokai, pages 315 to 1109, 1970, or *Shikizai Kogaku Handbook* (*Handbook of Coloring Material Technology*), edited by Shikizai Kyokai, pages 225 to 417, 1989 may be used, but a dye represented by the following formula (FA) is preferably used in the present invention.

$$D\text{-}(X)_y \qquad \text{(FA)}$$

wherein D represents a compound having a chromophore; X represents an ionizable proton bonded directly or via a divalent linking group to D, or a group having an ionizable proton; and y represents an integer of from 1 to 7.

The compound having a chromophore represented by D can be selected from among various known dye compounds.

As such compounds, an oxonol dye, a merocyanine dye, a cyanine dye, an arylidene dye, an azomethine dye, a triphenylmethane dye, an azo dye, an anthraquinone dye, or an indoaniline dye can be cited.

The ionizable proton or a group having an ionizable proton represented by X has such characteristics as it is non-dissociative (non-ionizable) in the state when the compound represented by formula (FA) is contained in a silver halide photographic material and makes the compound represented by formula (FA) substantially water-insoluble, and is dissociated (ionized) during development processing of the material and makes the compound represented by formula (FA) substantially water-soluble. Examples of such groups include a carboxylic acid group, a sulfonamido group, an arylsulfamoyl group, a sulfonylcarbamoyl group, a carbonylsulfamoyl group, an enol group of an oxonol dye, and a phenolic hydroxyl group.

The compound represented by formula (FA) is preferably represented by the following formula (FA1), (FA2) or (FA3), and (FA1) is particularly preferred.

$$A^1=L^1-(L^2=L^3)_m-Q \quad \text{(FA1)}$$

$$A^1=L^1-(L^2=L^3)_n-A^2 \quad \text{(FA2)}$$

$$A^1=(L^1-L^2)_n=B^1 \quad \text{(FA3)}$$

wherein $A^1$ and $A^2$ each represents an acid nucleus; $B^1$ represents a basic nucleus; Q represents an aryl group or a heterocyclic group; $L^1$, $L^2$ and $L^3$ each represents a methine group; m represents 0, 1 or 2; and n represents 0, 1, 2 or 3; provided that the compound represented by formula (FA1), (FA2) or (FA3) contains, in one molecule, at least one group selected from the group consisting of a carboxylic acid group, a sulfonamido group, an arylsulfamoyl group, a sulfonylcarbamoyl group, a carbonylsulfamoyl group, an enol group of an oxonol dye, and a phenolic hydroxyl group and does not contain a water-soluble group other than the above (e.g., a sulfonic acid group, a phosphoric acid group).

The acid nucleus represented $A^1$ and $A^2$ is preferably a cyclic ketomethylene compound or a compound having the methylene group between electron withdrawing groups.

Examples of cyclic ketomethylene compounds include 2-pyrazolin-5-one, rhodanine, hydantoin, thiohydantoin, 2,4-oxazolidinedione, isooxazolone, barbituric acid, thiobarbituric acid, indanedione, dioxopyrazolopyridine, hydroxypyridone, pyrazolidinedione, and 2,5-dihydrofuran-2-one. These compounds may have substituents.

A compound having the methylene group between electron withdrawing groups may be represented by $Z^1CH_2Z^2$, wherein $Z^1$ and $Z^2$ each represents —CN, —$SO_2R^1$, —$COR^1$, —$COOR^2$, —$CONHR^2$, —$SO_2NHR^2$, —C[=C$(CN)_2$]$R^1$ or —C[=C$(CN)_2$]$NHR^1$; $R^1$ represents an alkyl group, an aryl group or a heterocyclic group; and $R^2$ represents a hydrogen atom or a group represented by $R^1$; and each of them may have a substituent.

Examples of the basic nuclei represented by $B^1$ include pyridine, quinoline, indolenine, oxazole, imidazole, thiazole, benzoxazole, benzimidazole, benzothiazole, oxazoline, naphthoxazole and pyrrole, and each of them may have a substituent.

Examples of the aryl groups represented by Q include a phenyl group and a naphthyl group. Each of them may have a substituent. Examples of the heterocyclic groups represented by Q include pyrrole, indole, furan, thiophene, imidazole, pyrazole, indolizine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiazole, pyrrolopyridazine, tetrazole, oxazole, coumarin and coumarone. Each of them may have a substituent.

The methine groups represented by $L^1$, $L^2$ and $L^3$ may have a substituent, and the substituents may be bonded with each other to form a 5- or 6-membered ring (e.g., cyclopentene, cyclohexene).

The substituents that each of the above-described group may have are not particularly limited provided that they substantially do not dissolve the compounds represented by formulae (FA) and (FA1) to (FA3) in water of pH 5 to 7. Examples thereof include a carboxylic acid, a sulfonamido group having from 1 to 10 carbon atoms (e.g., methanesulfonamido, benzenesulfonamido, butanesulfonamido, n-octanesulfonamido), a sulfamoyl group having from 0 to 10 carbon atoms (e.g., unsubstituted sulfamoyl, methylsulfamoyl, phenylsulfamoyl, butylsulfamoyl), a sulfonylcarbamoyl group having from 2 to 10 carbon atoms (e.g., methanesulfonylcarbamoyl, propanesulfonylcarbamoyl, benzenesulfonylcarbamoyl), an acylsulfamoyl group having from 1 to 10 carbon atoms (e.g., acetylsulfamoyl, propionylsulfamoyl, pivaloylsulfamoyl, benzoylsulfamoyl), an acyclic or cyclic alkyl group having from 1 to 8 carbon atoms (e.g., methyl, ethyl, isopropyl, butyl, hexyl, cyclopropyl, cyclopentyl, cyclohexyl, 2-hydroxyethyl, 4-carboxybutyl, 2-methoxyethyl, benzyl, phenethyl, 4-carboxybenzyl, 2-diethylaminoethyl), an alkenyl group having from 2 to 8 carbon atoms (e.g., vinyl, allyl), an alkoxyl group having from 1 to 8 carbon atoms (e.g., methoxy, ethoxy, butoxy), a halogen atom (e.g., F, Cl, Br), an amino group having from 0 to 10 carbon atoms (e.g., unsubstituted amino, dimethylamino, diethylamino, carboxyethylamino), an alkoxycarbonyl group having from 2 to 10 carbon atoms (e.g., methoxycarbonyl), an amido group having from 1 to 10 carbon atoms (e.g., acetylamino, benzamido), a carbamoyl group having from 1 to 10 carbon atoms (e.g., unsubstituted carbamoyl, methylcarbamoyl, ethylcarbamoyl), an aryl group having from 6 to 10 carbon atoms (e.g., phenyl, naphthyl, 4-carboxyphenyl, 3-carboxyphenyl, 3,5-dicarboxyphenyl, 4-methanesulfonamidophenyl, 4-butanesulfonamidophenyl), an aryloxy group having from 6 to 10 carbon atoms (e.g., phenoxy, 4-carboxyphenoxy, 3-methylphenoxy, naphthoxy), an alkylthio group having from 1 to 8 carbon atoms (e.g., methylthio, ethylthio, octylthio), an arylthio group having from 6 to 10 carbon atoms (e.g., phenylthio, naphthylthio), an acyl group having from 1 to 10 carbon atoms (e.g., acetyl, benzoyl, propanoyl), a sulfonyl group having from 1 to 10 carbon atoms (e.g., methanesulfonyl, benzenesulfonyl), a ureido group having from 1 to 10 carbon atoms (e.g., ureido, methylureido), a urethane group having from 2 to 10 carbon atoms (e.g., methoxycarbonylamino, ethoxycarbonylamino), a cyano group, a hydroxyl group, a nitro group, a heterocyclic group (e.g., a 5-carboxybenzoxazole ring, a pyridine ring, a sulforan ring, a pyrrole ring, a pyrrolidine ring, a morpholine ring, a piperazine ring, a pyrimidine ring, and a furan ring.

Specific examples of the compounds represented by formulae (FA) and (FA1) to (FA3) for use in the present invention are shown below.

(F-1)
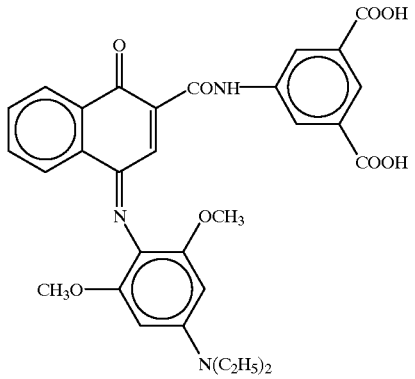
(F-2)
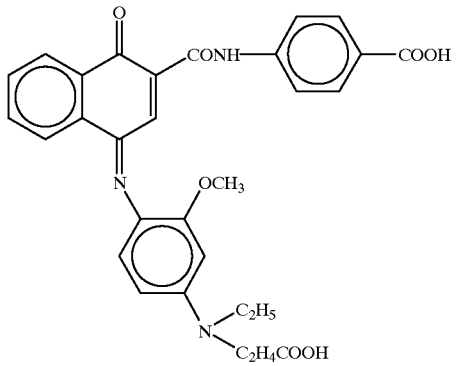
(F-3)
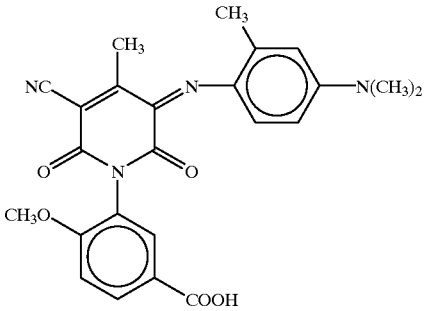
(F-4)
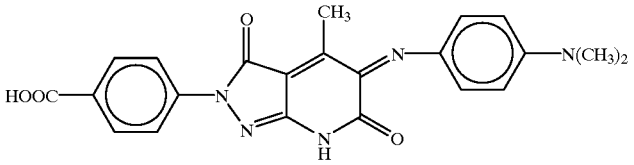
(F-5)
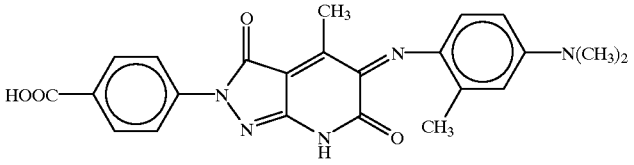

-continued
(F-6)
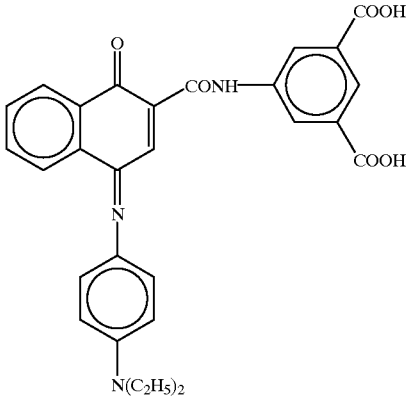
(F-7)
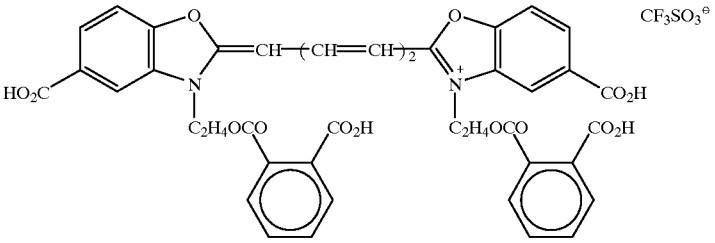
(F-8)
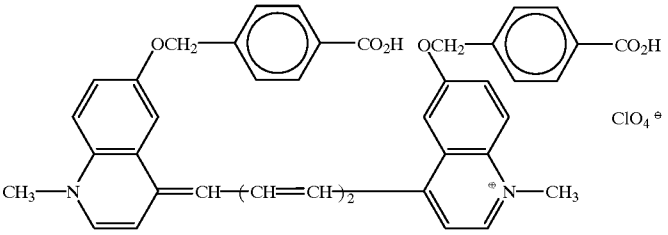
(F-9)
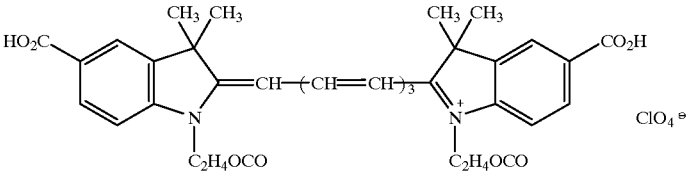
(F-10)
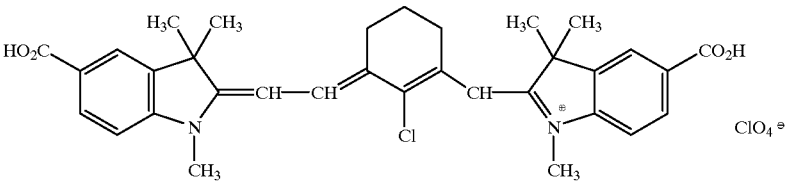
(F-11)
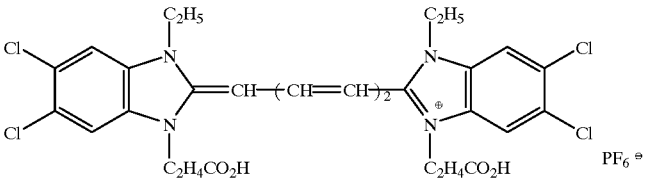

-continued
(F-12)
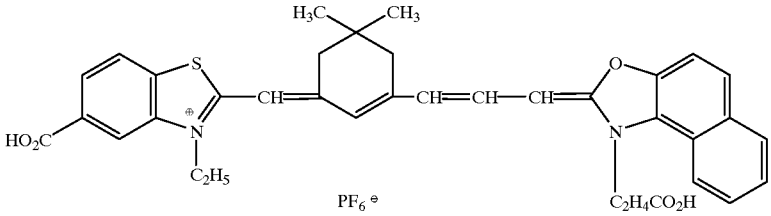
(F-13)
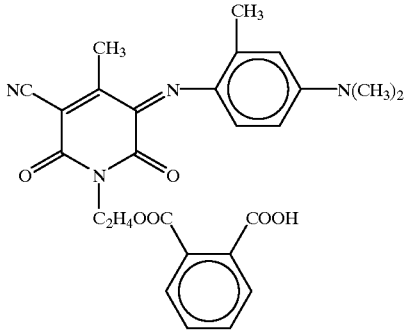
(F-14)
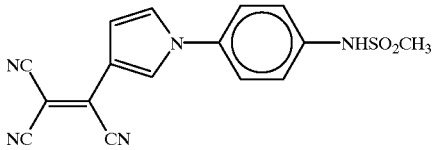
(F-15)
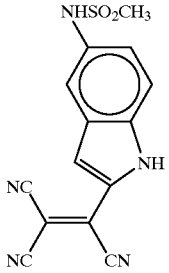
(F-16)
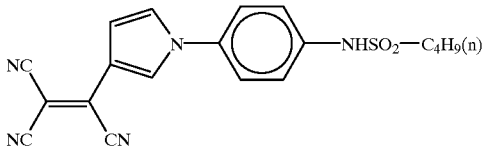
(F-17)
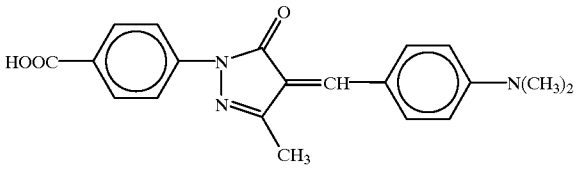
(F-18)
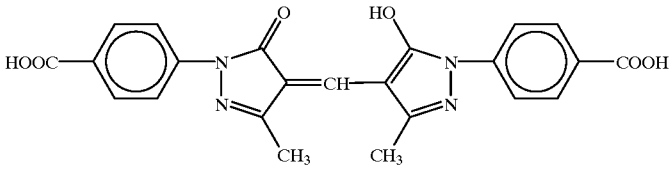

-continued
(F-19)
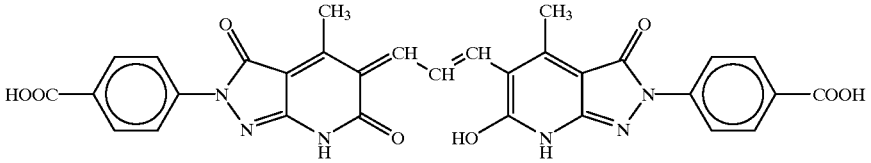
(F-20)
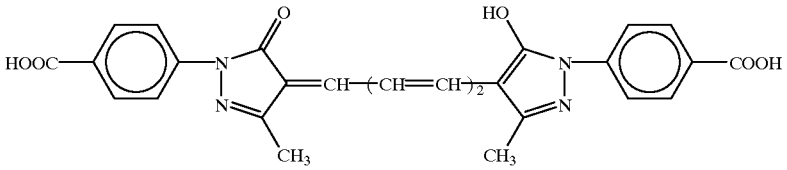
(F-21)
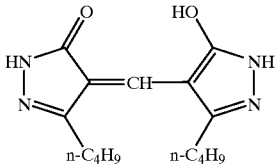
(F-22)
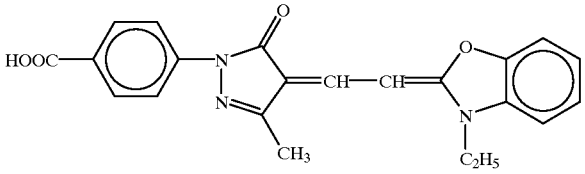
(F-23)
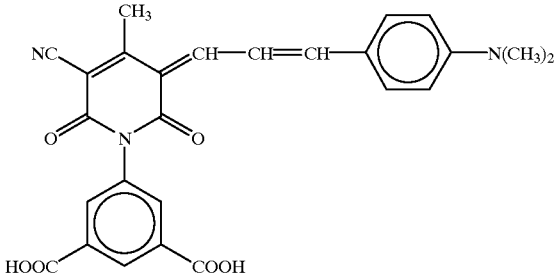
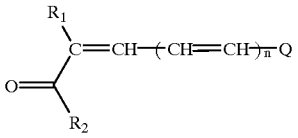
| No. | $R_1$ | $R_2$ | n | Q |
|---|---|---|---|---|
| F-24 | —CN | 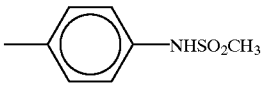 | 0 | 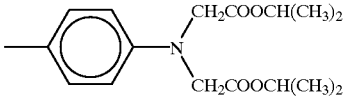 |
| F-25 | —CN | 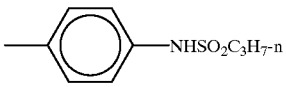 | 0 | 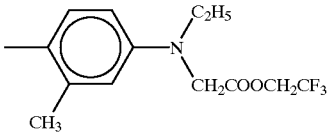 |

-continued

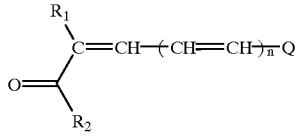

| No. | $R_1$ | $R_2$ | n | Q |
|---|---|---|---|---|
| F-26 | —CN | 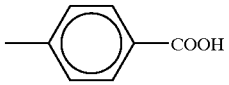 | 0 | 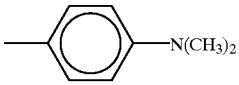 |
| F-27 | —CN | 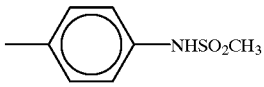 | 0 | 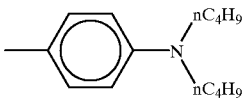 |
| F-28 | —CN | 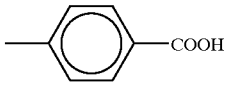 | 1 | 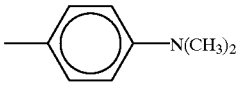 |
| F-29 | 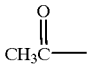 | 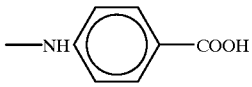 | 1 | 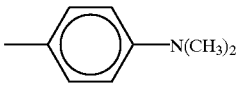 |
| F-30 | 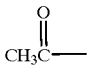 | 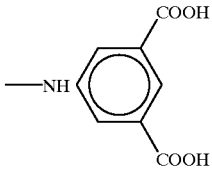 | 1 | 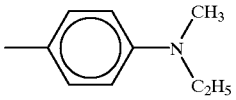 |
| F-31 | 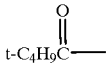 | 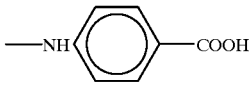 | 1 | 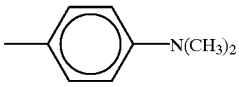 |
| F-32 | 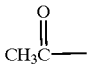 | 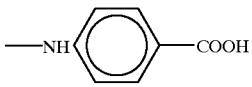 | 0 | 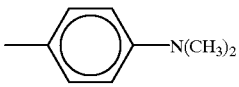 |
| F-33 | 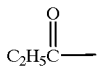 | 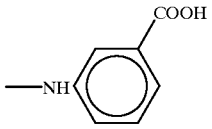 | 0 | 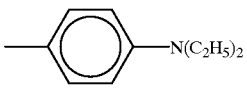 |
| F-34 | —CN | 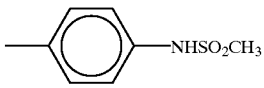 | 0 | 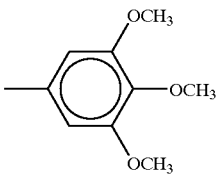 |

Other than the above, Compounds (II-2) to (II-24) of JP-A-7-152112 can be cited as specific examples of the compounds represented by formula (FA1), Compounds (III-5) to (III-18) of JP-A-7-152112 as specific examples of the compounds represented by formula (FA2), and Compounds (IV-2) to (IV-7) of JP-A-7-152112 as specific examples of the compounds represented by formula (FA3).

The dyes for use in the present invention can be synthesized according to the methods or corresponding to the methods disclosed in WO 88/4794, EP-A-274723, European Patent 276566, European Patent 299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429, 4,040,841, JP-A-2-282244, JP-A-3-7931, and JP-A-3-167546.

Besides the above, cyanine dyes, pyrylium dyes and aminium dyes disclosed in JP-A-3-138640 as solid fine particle dispersion dyes which are decolored at processing time, cyanine dyes having a carboxyl group disclosed in Japanese Patent Application No. 6-279297 (corresponding to EP 0 703 494 A1) as dyes which are not decolored at processing time, cyanine dyes which do not contain an acid group disclosed in JP-A-8-245902, laked cyanine dyes disclosed in Japanese Patent Application No. 7-135118, cyanine dyes disclosed in JP-A-1-266536, holopolar cyanine dyes disclosed in JP-A-3-136038, pyrylium dyes disclosed in JP-A-62-299959, polymer cyanine dyes disclosed in JP-A-7-253639, solid fine particle dispersion of oxonol dyes disclosed in JP-A-2-282244, light scattering grains disclosed in JP-A-63-131135, $Yb^{3+}$ compound disclosed in Japanese Patent Application No. 7-151380, ITO powder disclosed in JP-A-7-113072 and the like can be cited as the dyes which can be used in the present invention.

A solid fine particle dispersion of the dye represented by formula (F1) or (F2) is also preferably used in the present invention.

$$A^3=L_a-A^4 \quad \text{(F1)}$$

$$B^2=L_b-B^3(X^-)_{k-1} \quad \text{(F2)}$$

wherein $A^3$ and $A^4$ each represents an acid nucleus; $B^2$ represents a basic nucleus; $B^3$ represents an onium form of a basic nucleus; $L_a$ and $L_b$ each represents a linking group formed by bonding 5, 7, 9 or 11 methine groups by conjugated double bond; $X^-$ represents an anion; and k represents 2 or 1, and when the dye forms an inner salt, k represents 1.

The compounds represented by (F1) and (F2) are described in detail below.

The acid nucleus represented $A^3$ and $A^4$ is preferably a cyclic ketomethylene compound or a compound having the methylene group between electron withdrawing groups, such as 2-pyrazolin-5-one, isooxazolone, barbituric acid, thiobarbituric acid, pyridone, and dioxopyrazolopyridine are preferred above all, particularly preferably dioxopyrazolopyridine.

The basic nucleus represented by $B^2$ is a 5- or 6-membered nitrogen-containing heterocyclic ring which may be condensed, and examples thereof include an oxazole ring, an isooxazole ring, a benzoxazole ring, a naphthoxazole ring, a thiazole ring, a benzothiazole ring, a naphthothiazole ring, an indolenine ring, a benzindolenine ring, an imidazole ring, a benzimidazole ring, a naphthoimidazole ring, a quinoline ring, a pyridine ring, a benzoselenazole ring, a pyrrolopyridine ring, a furopyrrole ring, an indolizine ring, a quinoxaline ring, and an imidazoquinoxaline ring, preferably a 5-membered nitrogen-containing heterocyclic ring obtained by condensation of a benzene ring or a naphthalene ring, and more preferably an indolenine ring.

These rings may be substituted and examples of the substituents include, for example, a lower alkyl group (e.g., methyl, ethyl), an alkoxyl group (e.g., methoxy, ethoxy), a phenoxy group (e.g., unsubstituted phenoxy, p-chlorophenoxy), a halogen atom (e.g., Cl, Br, F), an alkoxycarbonyl group (e.g., ethoxycarbonyl), a cyano group, a nitro group, and a dissociative group.

Examples of dissociative groups include a carboxyl group, a phenolic hydroxyl group, a sulfonamido group and a sulfamoyl group. Dissociative groups may be laked by a cation. Of the cations which can be used for the lake of dyes, inorganic compounds include alkaline earth metal cations (e.g., $Mg^{2+}$, $Ca^{2+}$, $Ba^{2+}$, $Sr^{2+}$), transition metal cations (e.g., $Ag^+$, $Zn^{2+}$) and $Al^{3+}$. As organic compounds, ammonium having from 4 to 10 carbon atoms, amidinium, guanidinium cations can be cited, preferably divalent or trivalent cations.

$B^3$ represents an onium form of a basic nucleus and the oniums of the basic nuclei described for $B^2$ can be cited as examples thereof.

The methine groups in $L_a$ and $L_b$ may have substituents and the substituents may be bonded with each other to form a 5- or 6-membered ring (e.g., cyclopentene, cyclohexene). $L_a$ is preferably a linking group obtained by linking 5 methine groups by conjugated double bond and $L_b$ is preferably a linking group obtained by linking 7 methine groups by conjugated double bond.

As anions represented by $X^-$, there can be cited a halide ion (Cl, Br, I), a p-toluenesulfonate ion, an ethyl sulfate ion, $PF_6^-$, $BF_4^-$, and $ClO_4^-$. Further, the dyes may be laked by the anion represented by $X^-$. Examples of such anions include a phosphomolybdate anion, a phosphotungstate anion, and a silicomolybdate anion.

Specific examples of the compounds according to the present invention are shown below, but the present invention is not limited thereto.

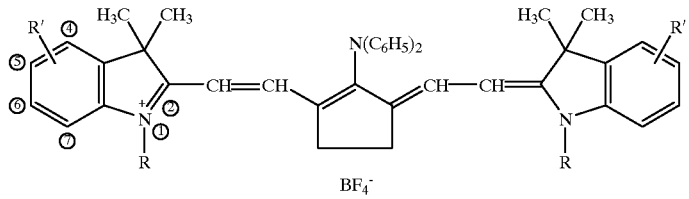

| Cpd. No. | R | R' |
|---|---|---|
| F-35 | $CH_3$ | H |
| F-36 | " | 5-Cl |
| F-37 | " | 5-$OCH_3$ |
| F-38 | " | 5-$CH_3$ |
| F-39 | " | 5-$CO_2C_2H_5$ |
| F-40 | " | 5,6-di-Cl |

-continued
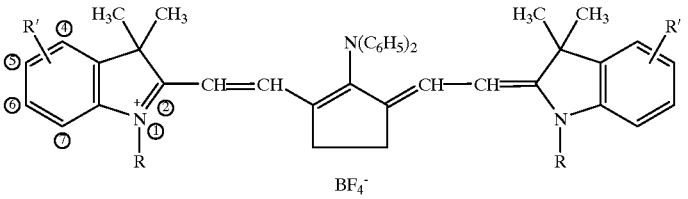
| Cpd. No. | R | R' |
|---|---|---|
| F-41 | " | 4,6-di-Cl |
| F-42 | $C_2H_5$ | 5-Cl |
| F-43 | $C_2H_4C_6H_5$ | 5-Cl |
| F-44 | $CH_3$ | 5-$CO_2H$ |
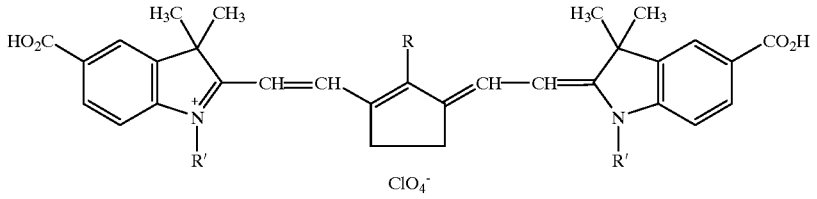
| Cpd. No. | R | R' |
|---|---|---|
| F-45 | $—N(CH_3)_2$ | $CH_3$ |
| F-46 | 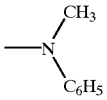 | " |
| F-47 | 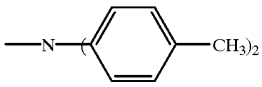 | " |
| F-48 | 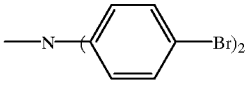 | " |
| F-49 | 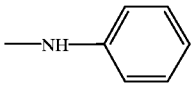 | " |
| F-50 | Cl | $CH_2Ph$ |
| F-51 | H | " |

-continued
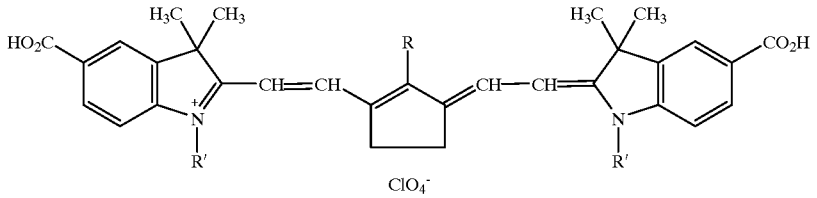
| Cpd. No. | R | R' |
|---|---|---|
| F-52 | 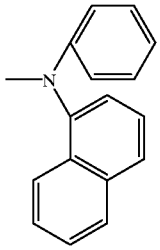 | $CH_3$ |
| F-53 | 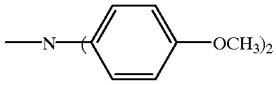 | " |
(Ph represents 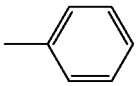 . Hereinafter the same.)
35
F-54
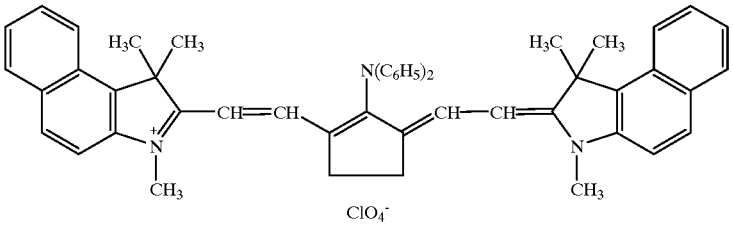
F-55
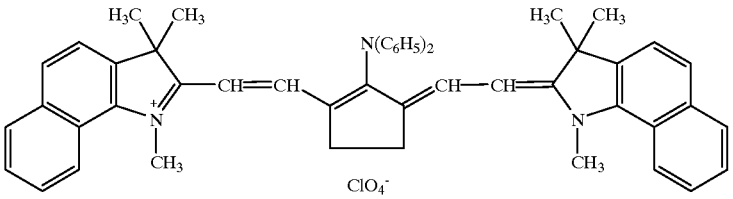

-continued
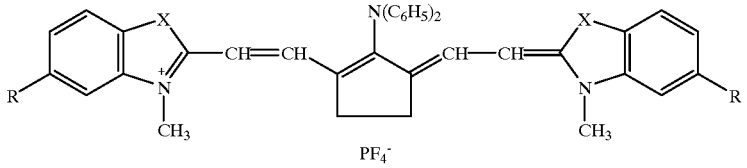
| Cpd. No. | X | R |
|---|---|---|
| F-56 | O | H |
| F-57 | S | Cl |
| F-58 | S | $CO_2H$ |
| F-59 | Se | H |
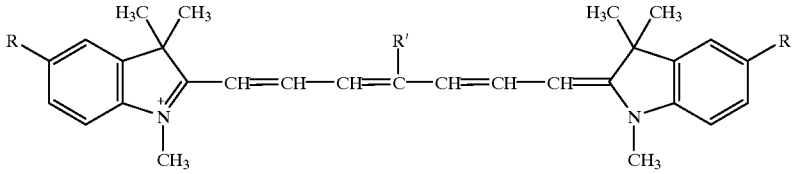
| Cpd. No. | R | R' |
|---|---|---|
| F-60 | H | $CH_3$ |
| F-61 | H | Cl |
| F-62 | H | $C_6H_5$ |
| F-63 | $CO_2H$ | $C_6H_5$ |
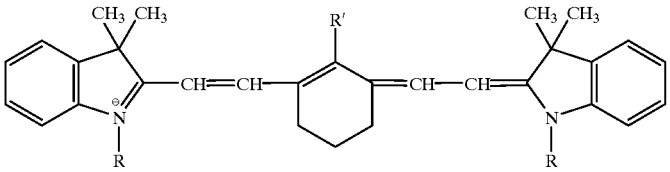
| Cpd. No. | R | R' |
|---|---|---|
| F-64 | $CH_3$ | Cl |
| F-65 | $CH_3$ | SPh |
| F-66 | $CH_3$ | OPh |
| F-67 | $—C_2H_4CO_2H$ | Cl |

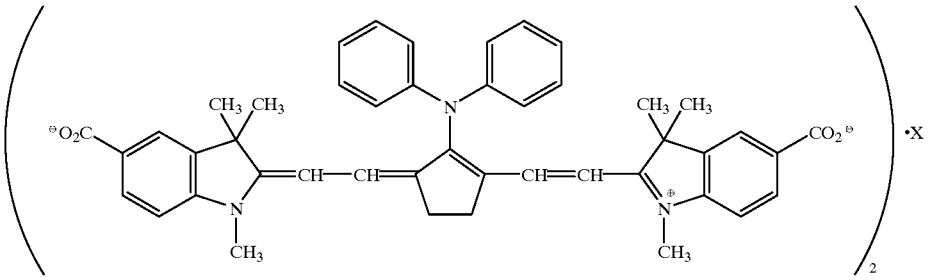
| Cpd. No. | X |
|---|---|
| F-68 | $Ca^{2\oplus}$ |
| F-69 | $Ba^{2\oplus}$ |
| F-70 | $Mg^{2\oplus}$ |
| F-71 | $Zn^{2\oplus}$ |
| F-72 | 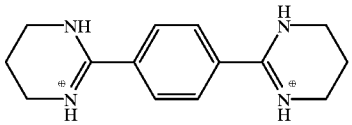 |
| F-73 | 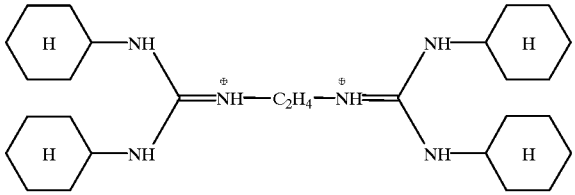 |
| F-74 | 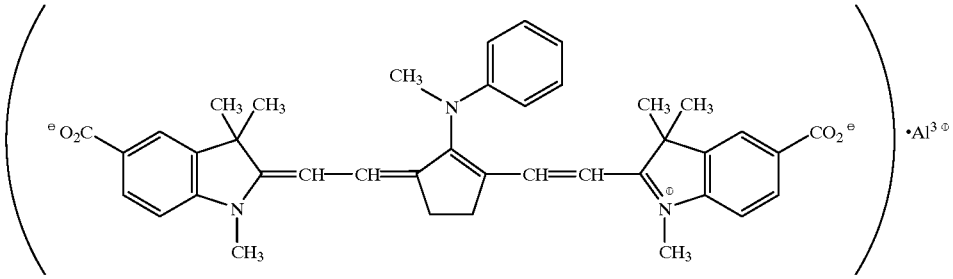 |

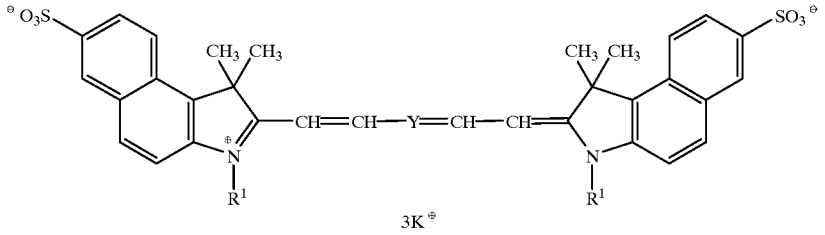
| Cpd. No. | $R^1$ | Y |
|---|---|---|
| F-75 | $-CH_2CH_2CH(SO_3^{\ominus})CH_3$ | 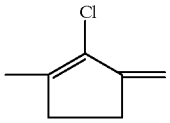 |
| F-76 | " | 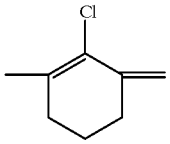 |
| F-77 | " | 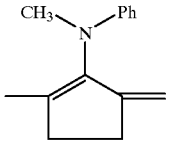 |
| F-78 | $-CH_2CH_2CH_2SO_3^{\ominus}$ | $-CH=CH-CH=$ |
| F-79 | " | 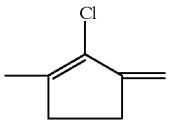 |
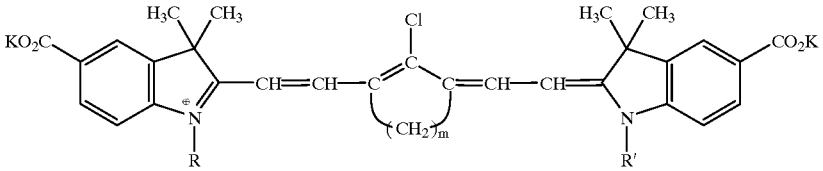
| Cpd. No. | R | R' | m |
|---|---|---|---|
| F-80 | $-(CH_2)_4-SO_3^{\ominus}$ | $-(CH_2)_4-SO_3K$ | 2 |
| F-81 | " | " | 3 |

-continued
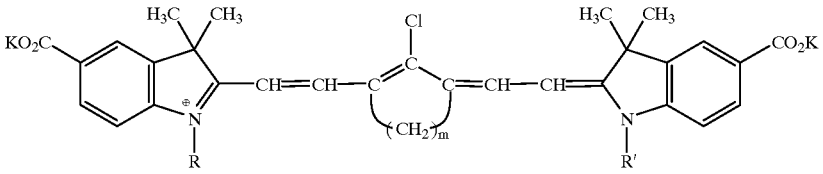
| Cpd. No. | R | R' | m |
|---|---|---|---|
| F-82 | $-(CH_2)_3-SO_3^{\ominus}$ | $-(CH_2)_3-SO_3K$ | 2 |
| F-83 | $-CH_2CH_2CH(SO_3^{\ominus})-CH_3$ | $-CH_2CH_2CH(SO_3K)-CH_3$ | 2 |
| F-84 | $-CH_2CH_2CH(SO_3^{\ominus})CH_3$ | $-CH_2CH_2CH(SO_3K)CH_3$ | 3 |
| F-85 | 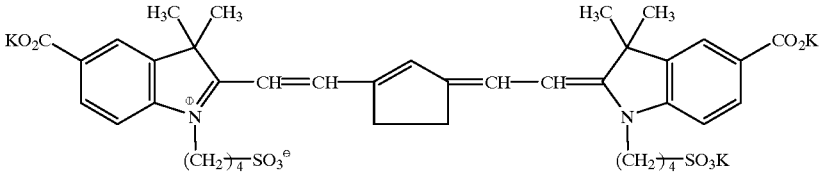 | | |
| F-86 | 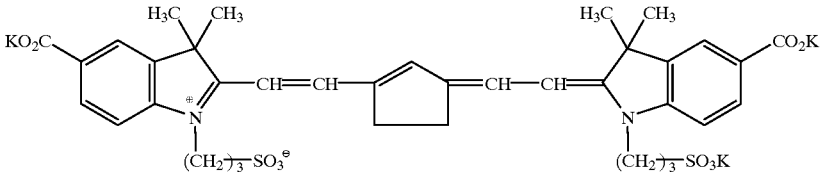 | | |
40
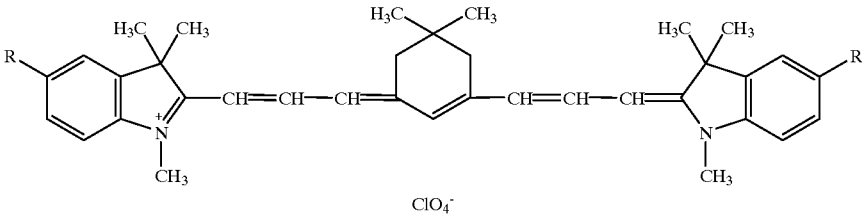
| Cpd. No. | R |
|---|---|
| F-87 | $CO_2H$ |
| F-88 | Cl |
| F-89 | H |

-continued
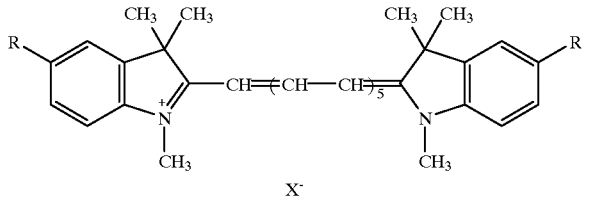
| Cpd. No. | R | $X^-$ |
|---|---|---|
| F-90 | H | $ClO_4^-$ |
| F-91 | $CO_2H$ | inner salt |
| F-92 | $SO_3K$ | inner salt |
F-93
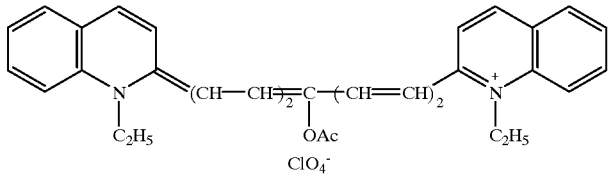
F-94
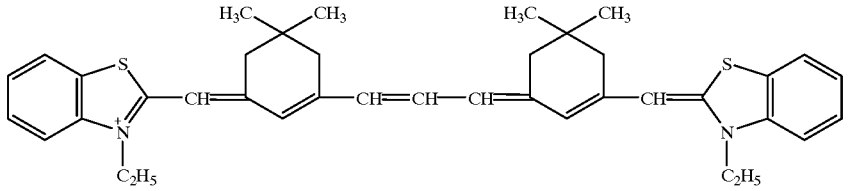
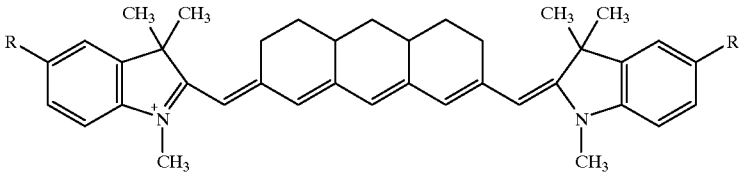
| Cpd. No. | R |
|---|---|
| F-95 | H |
| F-96 | $CO_2H$ |

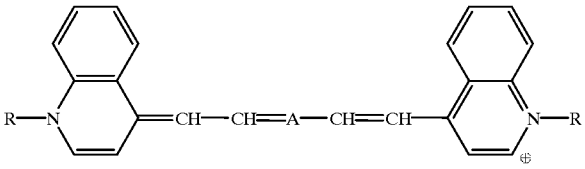
$BF_4^-$
| Cpd. No. | R | A |
|---|---|---|
| F-97 | $CH_3$ | 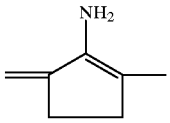 |
| F-98 | $C_2H_4CO_2H$ | " |
| F-99 | $C_2H_5$ | ═CH—CH═CH— |
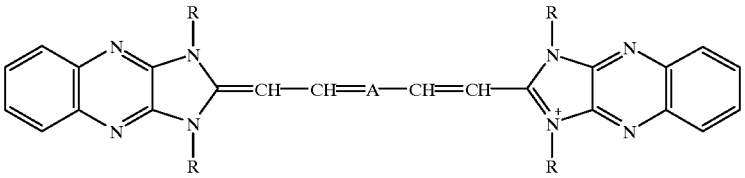
$ClO_4^-$
| Cpd. No. | R | A |
|---|---|---|
| F-100 | $C_2H_4CO_2H$ | ═CH—CH═CH— |
| F-101 | " | 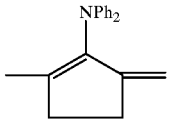 |
| F-102 | $C_3H_7$ | " |
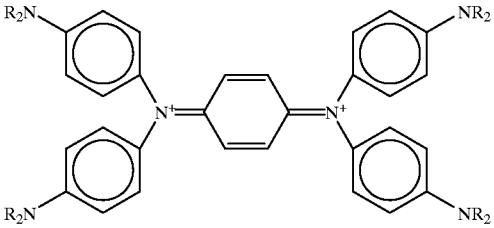
$2ClO_4^-$
| Cpd. No. | R |
|---|---|
| F-103 | n-$C_4H_9$ |
| F-104 | $CH_2CO_2H$ |
-continued
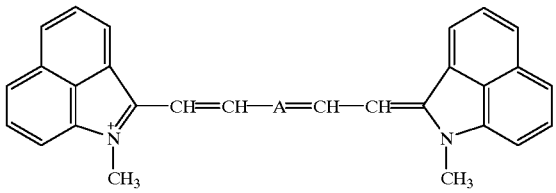
$BF_4^-$
| Cpd. No. | A |
|---|---|
| F-105 | —CH═CH—CH═ |
| F-106 | 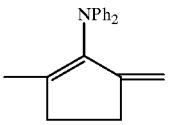 |

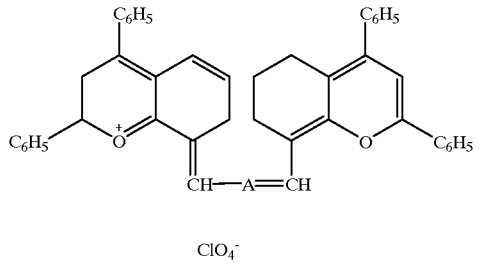

| Cpd. No. | A |
|---|---|
| F-107 | —CH= |
| F-108 | —CH=CH—CH= |

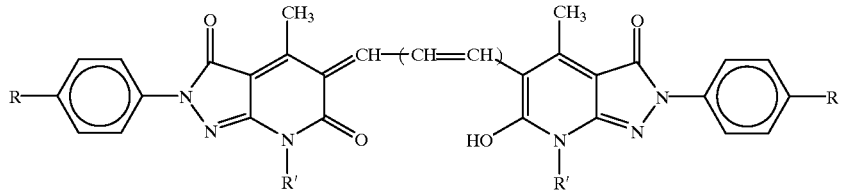

| Cpd. No. | R | R' |
|---|---|---|
| F-109 | $CO_2H$ | $CH_3$ |
| F-110 | " | H |
| F-111 | H | $CH_3$ |
| F-112 | " | H |

The dye for use in the present invention can be synthesized referring to JP-A-1-266536, JP-A-3-136038, JP-A-3-226736, JP-A-3-138640, JP-A-3-211542, Japanese Patent Application Nos. 6-227982, 6-227983, 6-279297, 7-54026, 7-101968, 7-135118, JP-A-2-282244, JP-A-7-113072 and JP-A-7-53946.

The dye according to the present invention may be a non-dissolving out dye (a dye or the reaction product of a dye and a processing solution does not dissolve out during development processing) or may be a dissolving out dye. A non-dissolving out dye is preferred in view of the reduction of replenishing rate of processing solutions and rapid processing provided that harmful absorption does not occur after development processing.

The solid fine particle dispersion of the above dyes can be produced mechanically by known pulverizing methods (e.g., using a ball mill, a vibrating ball mill, a planetary ball mill, a sand mill, a colloid mill, a jet mill, a roller mill) in the presence of a dispersing aid.

The above-described high molecular weight compounds are used as a dispersing aid and, if necessary, two or more of them may be used in combination. Known anionic, nonionic and cationic surfactants or polymers may be used at the same time but the use of only the above high molecular weight compounds is preferred. A dispersing aid is, in general, fed to a dispersing apparatus before dispersion as a slurry mixed with a dye powder or a wet cake, or it may be the form of a dye powder or a wet cake previously mixed with a dye and heat-treated or treated with a solvent. Alternatively, it can be added to a dispersing solution during dispersion as the degree of fine graining progresses. Further, a dispersing aid can be added to a dispersing solution for the stabilization of physical properties after dispersion. In any case, a solvent (e.g., water, alcohol) is generally present together with a dispersing aid. Before, after or during dispersion, pH may be controlled with an appropriate pH adjustor.

Other than mechanical dispersion, a dye may be dissolved in a solvent by controlling pH, thereafter may be finely grained by varying pH in the presence of a dispersing aid. An organic solvent may be used for dissolution at this time and the organic solvent is, in general, removed after completion of fine graining.

The prepared dispersion can be preserved with stirring or in a highly viscous state with hydrophilic colloid (for example, in a jelly-like state using gelatin) for the purpose of preventing the precipitation of fine grains during preservation. In addition, it is preferred to add preservatives for inhibiting the proliferation of various bacteria.

The average particle size of the thus-prepared solid fine particles of dye is from 0.005 $\mu$m to 10 $\mu$m, preferably from 0.01 $\mu$m to 3 $\mu$m, and in some case, from 0.05 to 0.5 $\mu$m.

A solid fine particle dispersion prepared using a high molecular weight compound having a repeating unit represented by formula (I) of the present invention and a dye may be added to any layer of hydrophilic colloid layers of a photographic material (a backing layer, an emulsion layer, a protective layer, an undercoat layer, an interlayer), but is preferably added to hydrophilic colloid layers other than emulsion layers. Two or more dyes may be added to the same layer or one dye can be added to a plurality of layers. Hydrophilic colloid is not particularly limited but generally gelatin is preferred.

Although the amount used of the dye as a solid content varies depending on the necessary absorbance and the absorption coefficient of the dispersion, it is generally used in an amount of from 0.001 to 5 g/m$^2$, preferably from 0.005 to 2 g/m$^2$, and still more preferably from 0.005 to 1 g/m$^2$. In the case of the photographic material is a both side-coated material, the dispersion can be added only to one side.

The photographic material of the present invention can contain known dyes other than the solid fine particle dispersion of the dye of the present invention, if required. Examples of such dyes are disclosed in JP-A-2-103536, page 17.

There is no limitation on the support of the silver halide photographic material of the present invention and those which are usually used in the art can be used.

For example, glass, a cellulose acetate film, a polyethylene terephthalate film, polyethylene naphthalate, paper, baryta coated paper, polyolefin (e.g., polyethylene, polypropylene) laminated paper, a polystyrene film, a polycarbonate film and a metal sheet such as aluminum and the like can be used as a support in the present invention.

These supports may be subjected to corona discharge treatment or undercoating treatment by known methods, as required.

The constitution of the silver halide photographic material of the silver halide emulsion layer side of the present invention is described below.

The silver halide emulsion layer of the silver halide photographic material of the present invention may comprise one layer or two or more layers.

The silver halide emulsion in the photographic material for use in the present invention is usually prepared by mixing a solution of water-soluble silver salt (e.g., silver nitrate) and a solution of water-soluble halide (e.g., potassium bromide) in the presence of a solution of water-soluble high molecular weight compound such as gelatin.

The silver halide in the silver halide emulsion for use in the present invention is not particularly limited and any of silver chloride, silver bromide, silver chlorobromide, silver iodobromide or silver chloroiodobromide can be used, and the form of the silver halide grain and the grain size distribution are also not particularly limited.

The form of the silver halide grain may be any of tabular grains having an aspect ratio of 3 or more, or a pebble-like, cubic or octahedral form. The silver halide photographic material of the present invention may have a surface protective layer, an interlayer, an antihalation layer, etc., besides the silver halide emulsion layer, and the surface protective layer may comprise two or more layers.

There is no particular limitation on various additives for use in the photographic material and development processing methods in the present invention and, for example, those described in the following corresponding places can preferably be used.

| Item | Places |
|---|---|
| 1) Silver halide emulsion and the preparation method thereof | line 12, right lower column, page 20 to line 14, left lower column, page 21 of JP-A-2-97937; and line 19, right upper column, page 7 to line 12, left lower column, page 8 of JP-A-2-12236 |
| 2) Spectral sensitizing dye | line 8, left upper column, page 7 to line 8, right lower column, page 8 of JP-A-2-55349 |
| 3) Surfactant and antistatic agent | line 7, right upper column, page 9 to line 7, right lower column, page 9 of JP-A-2-12236; and line 13, left lower column, page 2 to line 18, right lower column, page 4 of JP-A-2-18542 |
| 4) Antifoggant and stabilizer | line 19, right lower column, page 17 to line 4, right upper column, page 18 of JP-A-2-103526; and lines 1 to 5, right lower column, page 18 of JP-A-2-103526 |
| 5) Polymer latex | lines 12 to 20, left lower column, page 18 of JP-A-2-103526 |
| 6) Compound having acid group | line 6, right lower column, page 18 to line 1, left lower column, page 19 of JP-A-2-103526; and line 13, right lower column, page 8 to line 8, left upper column, page 11 of JP-A-2-55349 |
| 7) Polyhydroxybenzenes | line 9, left upper column, page 11 to line 17, right lower column, page 11 of JP-A-2-55349 |
| 8) Matting agent, sliding agent and plasticizer | line 15, left upper column, page 19 to line 15, right upper column, page 19 of JP-A-2-103526 |
| 9) Hardening agent | lines 5 to 17, right upper column, page 18 of JP-A-2-103536 |
| 10) Dye | lines 1 to 18, right lower column, page 17 of JP-A-2-103536 |
| 11) Binder | lines 1 to 20, right lower column, page 3 of JP-A-2-18542 |
| 12) Hydrazine nucleating agent | line 19, right upper column, page 2 to line 3, right upper column, page 7 of JP-A-2-12236; and formula (II) and Compounds II-1 to II-54 in line 1, right lower column, page 20 to line 20, right upper column, page 27 of JP-A-3-174143 |
| 13) Nucleation accelerator | formulae (II-m) to (II-p) and Compounds II-1 to II-22 in line 13, right upper column, page 9 to line 10, left upper column, page 16 of JP-A-2-103536; and compounds disclosed in JP-A-1-179939 |
| 14) Developing solution and developing method | line 1, right lower column, page 13 to line 10, left upper column, page 16 of JP-A-2-55349 |

The present invention is applicable to various silver halide photographic materials such as materials for printing, for microfilms, for medical X-ray use, for industrial X-ray use, general negative photographic materials, general reversal photographic materials and color photographic materials.

The present invention is described in detail with reference to the examples, but it should not be construed as being limited thereto.

EXAMPLE 1

Preparation of Solid Fine Particle Dispersion of Dye

The dye was handled as a wet cake not being dried, and 6.3 g as dry solid content was weighed. A dispersing aid was made a 10 wt % aqueous solution and 30 wt % as dry solid content based on dye solid content was added. Water was added to make the entire amount 63.3 g, then they were thoroughly mixed to make a slurry. Next, 100 ml of zirconia beads having an average diameter of 0.5 mm were filled in a vessel with the slurry and the content was dispersed with a disperser (1/16 G sand grinder mill, manufactured by Imex Co.) for 6 hours, then water was added to dilute the dispersion to dye concentration of 8 wt % and a solid fine particle dispersion solution of the dye was obtained. The dyes and dispersing aids used are shown in Table 1 below.

The desired average grain size was obtained by controlling dispersing time.

The obtained dispersion (5 wt % as dye solid content) was mixed with photographic gelatin of the amount of equal wt % to that of the dye solid content, and the following compound was added as a preservative by diluting with an aqueous solution so as to the amount became 2,000 ppm based on gelatin and refrigerated and preserved in a jelly-like state.

TABLE 1

| No. of Solid Fine Particle Dispersion of Dye | Dye | Dispersing Aid | Average Particle Size (μm) |
|---|---|---|---|
| Invention 1 | F-54 | WP-5 | 0.30 |
| Invention 2 | F-55 | WP-5 | 0.42 |
| Invention 3 | F-44 | WP-5 | 0.41 |
| Invention 4 | F-44 | WP-7 | 0.50 |
| Invention 5 | F-44 | WP-2 | 0.28 |
| Comparison 6 | F-44 | WP-101 | 2.0 very viscous |
| Comparison 7 | F-44 | WP-102 | 0.6 |
| Invention 8 | F-45 | WP-5 | 0.45 |
| Invention 9 | F-47 | WP-5 | 0.37 |
| Comparison 10 | F-47 | WP-102 | 1.3 |
| Invention 11 | F-17 | WP-5 | 0.35 |
| Invention 12 | F-18 | WP-5 | 0.27 |
| Invention 13 | F-20 | WP-5 | 0.48 |
| Invention 14 | F-21 | WP-5 | 0.41 |
| Invention 15 | F-19 | WP-5 | 0.45 |

WP-101

Carboxymethyl Cellulose Sodium Salt (trade name: Cellogen 6A, manufactured by Daiichi Kogyo Seiyaku Co., Ltd.)

WP-102

Formalin condensation product of sodium naphthalene-sulfonate (trade name: Demol SNB, manufactured by Kao K.K.)

Preservative

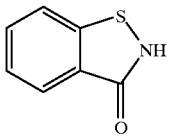

As is clear from the results of Table 1, dye dispersions having fine particles were obtained when the high molecular weight compound of the present invention was used as a dispersing aid. In comparison 6, the dispersion got viscous and the particles were not fined. In Comparison 10, the particles were not further fined.

Preparation of Emulsion Coating Solution 3 g of sodium chloride, low molecular weight gelatin having an average molecular weight of 20,000 and 0.04 g of 4-aminopyrazolo[3,4-d]pyrimidine (produced by Tokyo Kasei Kogyo Co., Ltd.) were added to 820 ml of water, an aqueous solution containing 10.0 g of silver nitrate and an aqueous solution containing 5.61 g of potassium bromide and 0.72 g of potassium chloride were added by a double jet method, with stirring, to the vessel maintained at 55° C. over 30 seconds. Subsequently, an aqueous solution containing 20 g of oxidized gelatin (alkali-processed gelatin processed with hydrogen peroxide) and 6 g of potassium chloride was added thereto, and the reaction solution was allowed to stand for 25 minutes. Then, an aqueous solution containing 155 g of silver nitrate and an aqueous solution containing 87.3 g of potassium bromide and 21.9 g of potassium chloride were added thereto by a double jet method over 58 minutes. The feed rate at this time was accelerated so that the feed rate at the time of termination of the addition reached 3 times that of the starting time of the addition.

Still further, an aqueous solution containing 5 g of silver nitrate and an aqueous solution containing 2.7 g of potassium bromide, 0.6 g of sodium chloride and 0.013 g of $K_4Fe(CN)_6$ were added thereto by a double jet method over 3 minutes. Then, the temperature was lowered to 35° C., and soluble salts were removed by flocculation, the temperature was again raised to 40° C., and 28 g of gelatin, 0.4 g of zinc nitrate and 0.051 g of benzisothiazolone were added thereto, and pH was adjusted to 6.0 with sodium hydroxide. Grains having aspect ratio of 3 or more accounted for 80% or more of the projected area of all the grains obtained. The average diameter of the projected area was 0.85 μm, the average thickness was 0.151 μm, and the silver chloride content was 20 mol %.

After the temperature was increased to 56° C., 0.002 mol in terms of silver of silver iodide fine grains (average grain size: 0.05 μm) was added to the reaction mixture while stirring, then 4.8 mg of sodium ethylthiosulfonate, 500 mg of Sensitizing Dye (1) having the structure shown below and 115 mg of 4-hydroxy-6-methyl-1,3,3a,7-tetraazaindene were added thereto. Further, 1.8 mg of chloroauric acid, 100 mg of potassium thiocyanate, 1.8 mg of sodium thiosulfate pentahydrate and 2.15 mg of selenium compound having the structure shown below were added thereto. The solution was chemically ripened for 50 minutes, then suddenly cooled to obtain Emulsion A.

Sensitizing Dye (1)

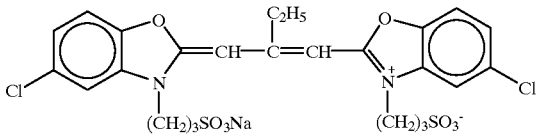

Selenium Compound

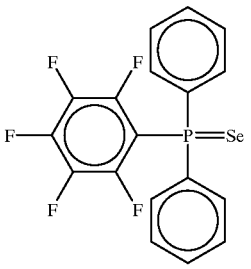

The following compounds were added to Emulsion A so that the coating weight of each component became as indicated below.

| | |
|---|---|
| 2,6-Bis(hydroxyamino)-4-diethylamino-1,3,5-triazine | 3 mg/m$^2$ |
| Dextran (average molecular weight: (60,000) | 0.47 g/m$^2$ |
| Sodium Polystyrenesulfonate | 30 mg/m$^2$ |
| Compound A | 115 mg/m$^2$ |

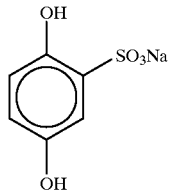

| | |
|---|---|
| Compound B | 5 mg/m$^2$ |

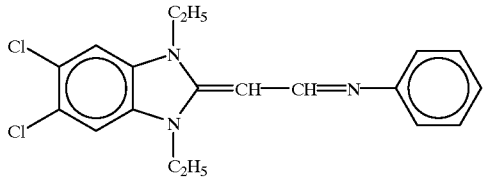

| | |
|---|---|
| Gelatin | 1.0 g/m$^2$ |
| Coated Silver Amount | 1.20 g/m$^2$ |

Preparation of Photographic Material

On both surfaces of a polyethylene terephthalate film colored bluish having a thickness of 180 $\mu$m both surfaces of which were undercoated were coated a dye layer, an emulsion layer and a surface protective layer in order from the nearest side of the support and Photographic Materials 101 to 110 were obtained.

The coating amount of each component per one side of the dye layer and the surface protective layer is as follows.

| | |
|---|---|
| Dye Layer | |
| Gelatin | 0.28 g/m$^2$ |
| Solid Fine Particle Dispersion of Dye (as dye solid content) | 15 mg/m$^2$ |
| Sodium Polyacrylate | 10 mg/m$^2$ |
| Surface Protective Layer | |
| Gelatin | 1.00 g/m$^2$ |
| Matting Agent (grain of methyl methacrylate/styrene/methacrylic acid = 76.3/17.5/6.2, diameter: 4.25 $\mu$m) | 0.10 g/m$^2$ |
| Coating Aids I to IV | as shown below |
| Sodium Polyacrylate | 25 mg/m$^2$ |
| The Following Compound (1) | 2 mg/m$^2$ |
| The Following Compound (2) | 0.3 mg/m$^2$ |
| The Following Compound (3) | 4 mg/m$^2$ |

Compound (1)

-continued

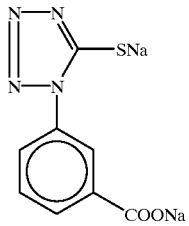

Compound (2)

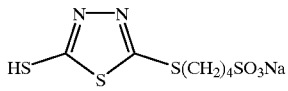

Compound (3)

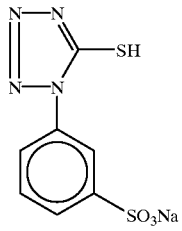

Coating Aid I 22 mg/m$^2$

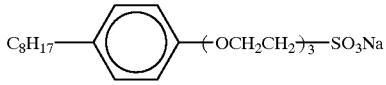

-continued

| | | |
|---|---|---|
| Coating Aid II | $C_{16}H_{33}O-(CH_2CH_2O)_{10}-H$ | 35 mg/m$^2$ |
| Coating Aid III | $C_8F_{17}SO_3K$ | 5 mg/m$^2$ |
| Coating Aid IV | $C_8F_{17}SO_2N(C_3H_7)-(CH_2CH_2O)_4-(CH_2)_4-SO_3Na$ | 1 mg/m$^2$ |

Further, 1,2-bis(vinylsulfonylacetamido)ethane was coated as a hardening agent so that the coating weight became 43 mg/m$^2$.

Preparation of Concentrated Developing Solution

Concentrated developing solution A of the prescription shown below using sodium erythorbate as a developing agent was prepared.

| | |
|---|---|
| Diethylenetriaminepentaacetic Acid | 8.0 g |
| Sodium Sulfite | 10.0 g |
| Sodium Carbonate Monohydrate | 50.0 g |
| Potassium Carbonate | 56.0 g |
| Sodium Erythorbate | 60.0 g |
| 4-Hydroxymethyl-4-methyl-1-phenyl-3-pyrazolidone | 13.2 g |
| 3,3'-Diphenyl-3,3'-dithiopropionic Acid | 1.44 g |
| Diethylene Glycol | 50.0 g |
| 2,5-Dimercapto-1,3,4-thiadiazole 1,3,4-thiadiazole | 0.15 g |
| Water to make | 1 liter |
| pH was adjusted with sodium hydroxide | 10.5 |

Preparation of Developing Replenisher

The above concentrated developing solution was diluted with water to two-fold and this was used as a developing replenisher.

Preparation of Developing Mother Solution

Two liters of the above concentrated developing solution was diluted with water to make 4 liters, and the starter solution having the following composition was added to the diluted developing solution in an amount of 60 ml per liter of the diluted developing solution. Thus, the developing mother solution having pH of 9.6 was prepared.

| Starter Solution | |
|---|---|
| Potassium Bromide | 11.1 g |
| Acetic Acid | 10.8 g |
| Water to make | 60 ml |

Preparation of Concentrated Fixing Solution

The concentrated fixing solution having the following prescription was prepared.

| | |
|---|---|
| Water | 0.5 liters |
| Ethylenediaminetetraacetic Acid Dihydrate | 0.05 g |
| Sodium Thiosulfate Pentahydrate | 400 g |
| Sodium Bisulfite | 200 g |
| Sodium Hydroxide (49% aq. soln.) | 2.9 g |
| Water to make | 1 liter |
| pH was adjusted with sodium hydroxide | 5.2 |

Preparation of Fixing Replenisher

The above concentrated fixing solution was diluted with water to two-fold and this was used as a fixing replenisher.

Preparation of Fixing Mother Solution

Two liters of the above concentrated fixing solution was diluted with water to make 4 liters. The pH was 5.4.

Exposure and Processing of Photographic Material

Photographic materials were processed with an automatic processor FPM-800, a product of Fuji Photo Film Co., Ltd., the driving system of which was modified and also the open factor was modified to 0.02, using the above developing mother solution and the fixing mother solution. The developing solution and the fixing solution were fed with the developing replenisher and the fixing replenisher at the replenishing rate of 103 ml/m$^2$ of the photographic material.

| Step | Processing Temperature (° C.) | Processing Time (sec) |
|---|---|---|
| Development | 35 | 25 |
| Fixing | 35 | 25 |
| Washing | 25 | 22 |
| Drying | 55 | 40 |
| Total (dry to dry): | | 120 |

Evaluation of Samples

Evaluation of Detectability of Sensor

Samples were treated in an automatic developing machine (modified FPM-9000, Fuji Photo Film Co., Ltd.). Into the film inlet, ten sheets of the photographic material were inserted, and the number of the detected sheet was counted. The developing machine has an infrared ray emitting element (GL-514, Sharp Corporation) and a photoelectric element (PT501B, Sharp Corporation) at its film inlet. When the infrared ray is shielded with an inserted sample sheet, the conveying rollers automatically work to convey the sample sheet to a developing bath.

Evaluation of Non-Dissolving Out Capability

The degree of coloring of the developing solution after processing 100 sheets of 10×12 inch size using the above processor was evaluated visually. In the table, ○ means there was no problem of coloring and × means coloring was gradually generated and became the trouble.

Evaluation of Photographic Sensitivity

The sample was exposed to X-ray through water phantom of 10 cm using a screen (HR-4, Fuji Photo Film Co., Ltd.), while the sample was sandwiched with two screen. The sample was then developed in the automatic developing machine to obtain an image. The sensitivity of the samples was measured. The relative sensitivity was determined based on the fogging value (including base density) plus 1.0. The sensitivity in the relative value where the sensitivity of the sample 101 is 100. The results are set forth in Table 2 below.

TABLE 2

| Photographic Material | Dye Dispersion No. | Detectability of Sensor | Dissolving Out Capability | Sensitivity |
|---|---|---|---|---|
| Invention 101 | 1 | 10 | ○ | 100 |
| Invention 102 | 2 | 10 | ○ | 100 |
| Invention 103 | 3 | 10 | ○ | 100 |
| Invention 104 | 4 | 10 | ○ | 100 |
| Invention 105 | 5 | 10 | ○ | 100 |
| Comparison 106 | 6 | 0 | ○ | 100 |
| Comparison 107 | 7 | 2 | x | 60 |
| Invention 108 | 8 | 10 | ○ | 100 |
| Invention 109 | 9 | 10 | ○ | 100 |
| Comparison 110 | 10 | 2 | x | 10 |

As is apparent from the above results, each of the samples prepared according to the present invention is the excellent photographic material which has detectability of a sensor, is high sensitive, can provide a clear image, does not contaminate processing solutions, can undergo reduced replenishing rate and rapid processing.

EXAMPLE 2

Preparation of Silver Halide Emulsion 0.06 g of potassium bromide, 41 g of gelatin and 1.2 g of ammonia were added to 1 liter of water, and an aqueous solution of silver nitrate (silver nitrate: 203 g) and an aqueous solution containing potassium bromide and $K_2IrCl_6$ (the amount to reach $1\times10^{-7}$ mol per mol of the finished silver halide) were added by a controlled double jet method, with stirring, to the vessel maintained at 65° C. over 54 minutes while maintaining the pAg at 7.6. Then, 0.11 g of KI was added, thus cubic monodisperse (variation coefficient: 10%) silver bromide emulsion having average grain size of 0.40 μm was obtained. After the emulsion was desalted, 71 g of gelatin, 2.9 g of phenoxyethanol and 0.6 g of sodium polystyrenesulfonate as a thickener were added and the pH was adjusted to 6.2 and the pAg at 8.1. After the emulsion obtained was chemically sensitized while maintaining the temperature at 65° C. by adding sodium thiosulfate and chloroauric acid, 0.4 g of 4-hydroxy-6-methyl-1,3,3a,7-tetraazaindene was added, then suddenly cooled and solidified to obtain Emulsion B1.

A cubic monodisperse silver bromide emulsion (variation coefficient: 10%) having the average grain size of 0.28 μm was prepared in the same manner as the preparation of Emulsion B1 except for properly changing the temperature at the time of the controlled double jet method and the amount of ammonia, further changing the amount of $K_2IrCl_6$ to $3\times10^{-7}$ mol per mol of the finished silver halide, and thereafter in the same manner as Emulsion B1, Emulsion B2 was obtained. Thus-obtained Emulsions B1 and B2 were mixed in the ratio of 1/1 by weight and Emulsion Bmix was obtained.

Preparation of Emulsion Coating Solution

A coating solution was prepared by adding the following additives each in the amount shown per mol of the silver halide in the emulsion, then water was added to make 1.6 liters.

a. Sensitizing Dye (2) $3.4\times10^{-5}$ mol

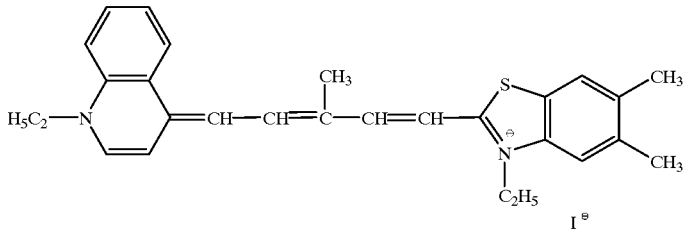

b. Supersensitizer 0.23 g

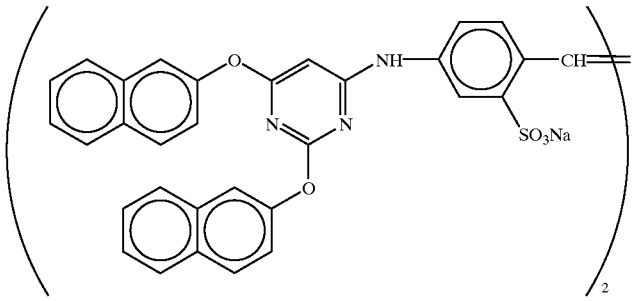

-continued

| | | |
|---|---|---|
| c. | Preservability Improver (1) | $2.5 \times 10^{-4}$ mol |

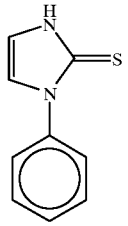

| | | |
|---|---|---|
| d. | Preservability Improver (2) | $7.5 \times 10^{-4}$ mol |

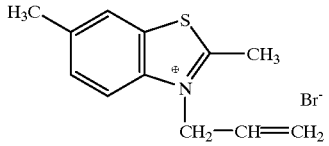

| | | |
|---|---|---|
| e. | Polyacrylamide (molecular weight: 40,000) | 9.3 g |
| f. | 2,6-Bis(hydroxyamino)-4-diethylamino-1,3,5-triazine | 0.15 g |
| g. | Copolymer Latex of Ethyl Acrylate/Acrylic Acid (95/5) | 12.9 g |
| h. | 1,2-Bis(vinylsulfonylacetamido)ethane | 1.69 g |
| i. | Sodium Polystyrenesulfonate | 1.3 g |

Preparation of Coating Solution for Surface Protective Layer

A coating solution was prepared by adding the additives to a reaction vessel which was heated to 40° C. according to the following prescription, then water was added thereto to make 1.5 liters.

| | | |
|---|---|---|
| a. | Gelatin | 100 g |
| b. | Polyacylamide (molecular weight: 40,000) | 13 g |
| c. | Sodium Polystyrene sulfonate (molecular weight: 600,000) | 2 g |
| d. | Polymethyl Methacrylate Fine Grains (average grain size 2.5 μm) | 2.1 g |
| e. | Polymethyl Methacrylate Fine Grains (average grain size 0.8 μm) | 3.4 g |
| f. | Sodium t-Octylphenoxyethoxyethanesulfonate | 1.6 g |
| g. | $C_{16}H_{33}O(CH_2CH_2O)_{10}H$ | 3.6 g |
| h. | $C_8F_{17}SO_3K$ | 0.07 g |
| i. | $C_8F_{17}SO_2N(C_3H_7)(CH_2CH_2O)_4(CH_2)_4SO_3Na$ | 0.09 g |
| j. | $C_8F_{17}SO_2N(C_3H_7)(CH_2CH_2O)_{15}H$ | 0.22 g |
| k. | NaOH | 0.1 g |
| l. | Compound (C) | 0.06 g |

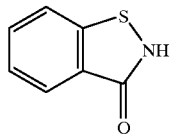

| | | |
|---|---|---|
| m. | 1,2-Bis(vinylsulfonylacetamido)-ethane | addition amount was adjusted to be 2 wt % based on the total gelating amount of the emulsion layer and the surface protective layer (swelling factor of 190% in water of 21° C.) |

-continued

Preparation of Coating Solution for Backing Layer

A reaction vessel was heated to 40° C., the additives were added thereto according to the following prescription, then water was added to make 1 liter and a coating solution for a backing layer was prepared.

| Prescription of Coating Solution for Backing Layer | |
|---|---|
| a. Gelatin | 100 g |
| b. Dye Solid Fine Particle Dispersion the kind shown in Table 3, 1.3 g as solid content | |
| c. Sodium Polystyrenesulfonate | 1.3 g |
| d. Copolymer Latex of Ethyl Acrylate/Acrylic Acid (95/5) | 2.2 g |
| e. 1,2-Bis(vinylsulfonylacetamido)ethane | 2.7 g |
| f. Compound (C) | 0.04 g |

Preparation of Dye Oil Dispersion L1

The following Dye D-2, High Boiling Point Solvent-I and High Boiling Point Solvent-II each in an amount of 2.5 g were dissolved in 50 ml of ethyl acetate, then the above solution was mixed with 90 g of an 8% aqueous solution of gelatin containing 1.5 g of sodium dodecylbenzenesulfonate and 0.18 g of methyl p-hydroxybenzoate at 60° C., and stirred at high speed with a homogenizer. After termination of high speed stirring, the mixture was processed with a solvent removing apparatus under reduced pressure and 92 wt % of ethyl acetate was removed. Thus, Dye Oil Dispersion L1 having the average grain size of 0.18 μm was obtained.

Dye D-2

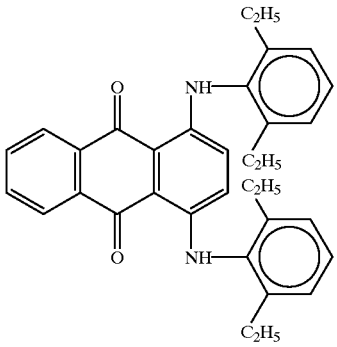

High Boiling Point Solvent-I

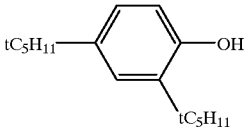

-continued

High Boiling Point Solvent-II

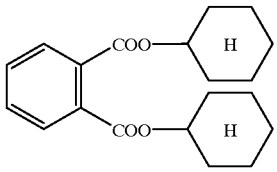

| | | |
|---|---|---|
| g. | Above Dye Oil Dispersion L1 | 15.0 g |
| h. | Dye Oil Dispersion of Dye D-3 disclosed in JP-A-61-285445 (as dye solid content) | 52 mg |

Dye D-3

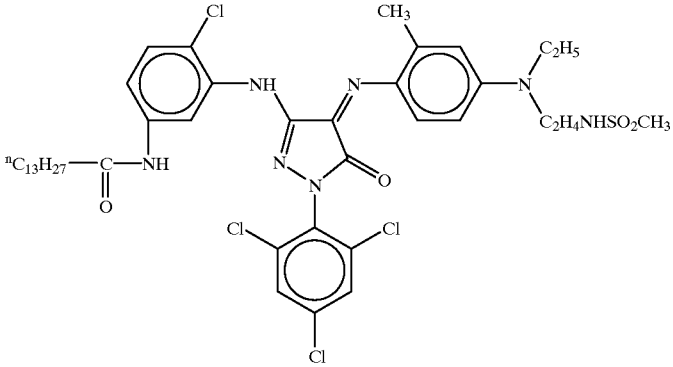

| | | |
|---|---|---|
| i. | Snowtex C (Nissan Chemical Industries, Ltd.) (as solid content) | 20 g |

Prescription of Coating Solution for Surface Protective Layer of Backing Layer

| | | |
|---|---|---|
| a. | Gelatin | 100 g |
| b. | Sodium Polystyrenesulfonate | 0.8 g |
| c. | 1,2-Bis(vinylsulfonylacetamido)-ethane | addition amount was adjusted to be 2.5 wt % based on the total gelatin amount of the backing layer and the surface protective layer (swelling factor of 150% in water of 21° C.) |
| d. | Polymethyl Methacrylate Fine Particles (average particle size 4.7 μm) | 3.1 g |
| e. | Sodium t-Octylphenoxyethoxyethanesulfonate | 2.0 g |
| f. | NaOH | 0.2 g |
| g. | Sodium Polyacrylate | 1.8 g |

-continued

| | | |
|---|---|---|
| h. | $C_{16}H_{33}O(CH_2CH_2O)_{10}H$ | 3.9 g |
| i. | $C_8F_{17}SO_3K$ | 0.05 g |
| j. | $C_8F_{17}SO_2N(C_3H_7)(CH_2CH_2O)_4(CH_2)_4SO_3Na$ | 0.08 g |
| k. | $C_8F_{17}SO_2N(C_3H_7)(CH_2CH_2O)_{15}H$ | 0.10 g |
| l. | Compound (C) | 0.05 g |

Preparation of Photographic Material

The above coating solution for a backing layer was coated with the coating solution for a surface protective layer of a backing layer on one side of a polyethylene terephthalate support colored bluish such that the gelatin coating amount of the backing layer became 2.3 g/m$^2$ and the gelatin coating amount of the surface protective layer of the backing layer became 1.0 g/m$^2$. Subsequently, on the opposite side of the support, the above emulsion coating solution and the coating solution for a surface protective layer were coated such that the amount of silver in the emulsion became 2.4 g/m$^2$, the amount of gelatin in the emulsion 1.7 g/m$^2$ and the amount of gelatin in the surface protective layer 1.1 g/m$^2$.

Thus, Photographic Materials 201 to 210 were prepared. The contents are shown in Table 3.

Evaluation of Photographic Material

After Photographic Materials 201 to 210 were allowed to stand at 25° C. 60% RH for seven days, subjected to objective test.

Evaluation of photographic capabilities were conducted as follows. Photographic materials were processed with a laser imager FL-IMD (a product of Fuji Photo Film Co., Ltd.), the driving system of which was modified and driving speed was increased to about 2.6 times and dry to dry time to 40 seconds (the time from the moment when the tip of the photographic material enters the film inlet, through processing, until the moment when it comes out from the processor is 40 seconds). Processing was carried out using RD•F-20 (products of Fuji Photo Film Co., Ltd.), respectively, as developing solution and fixing solution at 35° C., and photographic capabilities were evaluated.

Evaluation of Samples

Evaluation of Detectability of Sensor

Evaluation was conducted in the same manner as in Example 1.

Evaluation of Non-Dissolving Out Capability

The degree of coloring of the developing solution after processing 100 sheets of 10×12 inch size using the above processor was evaluated visually. In the table, ○ means there was no problem of coloring and × means coloring was gradually generated and became the trouble.

Evaluation of Photographic Sensitivity

Exposure was conducted using FLL-IMD manufactured by Fuji Photo Film Co., Ltd. Sensitivity was expressed by the logarithmic value of the reciprocal of the exposure amount required to give a density of 1.0 by laser scanning exposure, and was expressed by a relative value taking the sensitivity of Sample 201 as 100.

The results obtained are shown in Table 3 below.

TABLE 3

| Photographic Material | Dye Dispersion No. | Detectability of Sensor | Dissolving Out Capability |
|---|---|---|---|
| Invention 201 | 1 | 10 | ○ |
| Invention 202 | 2 | 10 | ○ |
| Invention 203 | 3 | 10 | ○ |
| Invention 204 | 4 | 10 | ○ |
| Invention 205 | 5 | 10 | ○ |
| Comparison 206 | 6 | 0 | ○ |
| Comparison 207 | 7 | 2 | x |
| Invention 208 | 8 | 10 | ○ |
| Invention 209 | 9 | 10 | ○ |
| Comparison 210 | 10 | 2 | x |

As is apparent from the above results, each of the samples prepared according to the present invention is the excellent photographic material which has detectability of a sensor, is high sensitive, can provide a clear image, does not contaminate processing solutions, can undergo reduced replenishing rate and rapid processing.

EXAMPLE 3

Preparation of {100} AgCl Tabular Emulsion C 1,582 ml of an aqueous solution of gelatin (containing 19.5 g of gelatin-1 (deionized alkali-processed ossein gelatin of a methionine content of about 40 μmol/g), 7.8 ml of $HNO_3$ 1 N solution, pH 4.8) and 13 ml of NaCl-1 solution (containing 10 g of NaCl in 100 ml of NaCl solution) were put in a reaction vessel, while maintaining the temperature at 40° C., 15.6 ml of Ag-1 solution (containing 20 g of $AgNO_3$ in 100 ml of Ag-1 solution) and 15.6 ml of X-1 solution (containing 7.05 g of NaCl in 100 ml of X-1 solution) were simultaneously added to the vessel and mixed at a rate of 62.4 ml/min. After stirring for 3 minutes, 28.2 ml of Ag-2 solution (containing 2 g of $AgNO_3$ in 100 ml of Ag-2 solution) and 28.2 ml of X-2 solution (containing 1.4 g of KBr in 100 ml of X-2 solution) were simultaneously added thereto and mixed at a rate of 80.6 ml/min. After stirring for 3 minutes, 46.8 ml of Ag-1 solution and 46.8 ml of X-1 solution were simultaneously added and mixed at a rate of 62.4 ml/min. After stirring for 2 minutes, 203 ml of an aqueous solution of gelatin (containing 1.3 g of acid-processed gelatin-1, 1.3 g of NaCl, and an NaOH 1 N solution to adjust pH to 5.5) was added to the reaction mixture, pCl was adjusted to 1.8, the temperature was raised to 75° C., after pCl was set at 1.8, ripening was carried out for 10 minutes. Subsequently, $1\times10^{-4}$ mol per mol of the silver halide of Disulfide Compound A was added, then AgCl fine grain emulsion (average grain size: 0.1 μm) was added to the mixture at AgCl addition rate of $2.68\times10^{-2}$ mol/min. for 20 minutes. Ripening was carried out for 10 minutes after termination of the addition, then a precipitant was added, the temperature was reduced to 35° C., the precipitate was washed with water, an aqueous solution of gelatin was added, and pH was adjusted to 6.0 at 60° C.

Disulfide Compound A

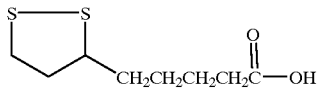

Transmission type electron microphotographic image (hereinafter referred to as TEM) of the replica of the grains were observed. The emulsion obtained was high silver chloride {100} tabular grains containing 0.44 mol % of AgBr based on the silver. The characteristic values of the shape of the grains were as follows:

(entire projected area of tabular grains having aspect ratio greater than 1/sum of projected area of all AgX grains)×100=$a_1$=90%

(average aspect ratio (average diameter/average thickness) of tabular grains)=$a_2$=9.3

(average diameter of tabular grains)=$a_3$=1.67 μm

| | |
|---|---|
| Solution (1) | |
| Inactive Gelatin | 30 g |
| Crystal Habit Inhibitor A | 0.6 g |

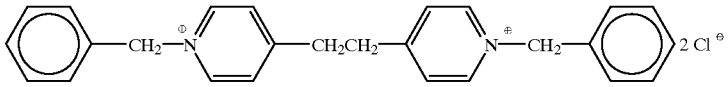

| | |
|---|---|
| Crystal Habit Inhibitor B | 0.4 g |

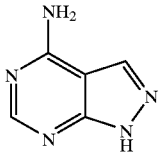

| | |
|---|---|
| NaCl | 4 g |
| $H_2O$ | 1,750 ml |
| Solution (2) | |
| $AgNO_3$ | 7.6 g |
| $H_2O$ to make | 30 cc |
| Solution (3) | |
| NaCl | 2.8 g |
| $H_2O$ to make | 30 ml |
| Solution (4) | |
| $AgNO_3$ | 24.5 g |
| $H_2O$ to make | 96 ml |
| Solution (5) | |
| NaCl | 0.3 g |
| $H_2O$ to make | 65 ml |
| Solution (6) | |
| $AgNO_3$ | 101.9 g |
| $H_2O$ to make | 400 ml |
| Solution (7) | |
| NaCl | 37.6 g |
| $H_2O$ to make | 400 ml |

(average thickness)=$a_4$=0.18 μm

Preparation of {111} AgCl Tabular Emulsion D

Silver chloride tabular grains were prepared as follows.

Solution (2) and Solution (3) were simultaneously added at a constant addition rate to Solution (1) maintained at 35° C. with stirring over 1 minute, the temperature of the solution was raised to 70° C. over 15 minutes. Grains corresponding to about 5.7% of the total silver amount were formed at this point. Then, Solution (4) and Solution (5) were simultaneously added at a constant addition rate over 24 minutes, further, Solution (6) and Solution (7) were added over 40 minutes at a constant addition rate of a silver nitrate solution so as to reach pCl of 1.0, grain growth was conducted by a controlled double jet method and silver chloride grains were obtained. Immediately after grain formation, $1\times10^{-4}$ mol per mol of the silver halide of Thiosulfonic Acid Compound-I was added.

Thiosulfonic Acid Compound-I $C_2H_5SO_2SNa$

After the emulsion obtained was washed by flocculation and desalted, 30 g of gelatin and $H_2O$ were added, further 2.0 g of phenoxyethanol and 0.8 g of sodium polystyrenesulfonate as a thickener were added, and the emulsion was again dispersed using sodium hydroxide to adjust pH to 6.0.

The thus-obtained emulsion had the characteristic values of the shape of: $a_1$=90%, $a_3$=1.55 μm, $a_4$=0.18 μm, $a_2$=8.6, and was a silver chloride tabular grain emulsion having {111} face as a main plane and variation coefficient of projected area diameter corresponding to circle of 19%.

Preparation of {111} AQBr Tabular Emulsion E 6.0 g of potassium bromide and 7.0 g of low molecular weight gelatin having an average molecular weight of 15,000 were added to 1 liter of water, and 37 ml of an aqueous solution of silver nitrate (silver nitrate: 4.00 g) and 38 ml of an aqueous solution containing 5.9 g of potassium bromide were added by a double jet method, with stirring, to the vessel maintained at 55° C. over 37 seconds. Subsequently, 18.6 g of gelatin was added thereto, and the temperature was raised to 70° C., then 89 ml of an aqueous solution of silver nitrate (silver nitrate: 9.80 g) was added over 22 minutes. 7 ml of a 25% aqueous solution of ammonia was added to the mixture, and physical ripening was carried out for 10 minutes while maintaining the temperature at 70° C., then 6.5 ml of a 100% acetic acid solution was added. Subsequently, an aqueous solution containing 153 g of silver nitrate and an aqueous solution of potassium bromide were added by a controlled double jet method over 35 minutes while maintaining pAg at 8.5. Then, 15 ml of a solution of 2 N potassium thiocyanate was added. After physical ripening was carried out over 5 minutes at that temperature, the temperature was lowered to 35° C. Thus, monodisperse pure silver bromide tabular grains having $a_1$=95%, an average projected area diameter $a_3$=1.50 μm, a thickness $a_4$=0.185 μm, an average aspect ratio $a_2$=8.1, and a variation coefficient of a diameter of 18.5% were obtained.

Next, soluble salts were removed by flocculation. The temperature was again raised to 40° C., and 30 g of gelatin, 2.35 g of phenoxyethanol and 0.8 g of sodium polystyrenesulfonate as a thickener were added, and pH and pAg were adjusted to 5.90 and 8.00, respectively, with sodium hydroxide and a solution of silver nitrate.

Preparation of {100} AgBrCl Tabular Emulsion F 1,582 ml of an aqueous solution of gelatin (containing 19.5 g of gelatin-1 (deionized alkali-processed ossein gelatin of a methionine content of about 40 μmol/g), 7.8 ml of $HNO_3$ 1N solution, pH 4.8) and 13 ml of NaCl-1 solution (containing 10 g of NaCl in 100 ml of NaCl solution) were put in a reaction vessel, while maintaining the temperature at 40° C., 15.6 ml of Ag-1 solution (containing 20 g of $AgNO_3$ in 100 ml of Ag-1 solution) and 15.6 ml of X-1 solution (containing 7.05 g of NaCl in 100 ml of X-1 solution) were simultaneously added to the vessel and mixed at a rate of 62.4 ml/min. After stirring for 3 minutes, 28.2 ml of Ag-2 solution (containing 2 g of $AgNO_3$ in 100 ml of Ag-2 solution) and 28.2 ml of X-2 solution (containing 1.4 g of KBr in 100 ml of X-2 solution) were simultaneously added thereto and mixed at a rate of 80.6 ml/min. After stirring for 3 minutes, 46.8 ml of Ag-1 solution and 46.8 ml of X-1 solution were simultaneously added and mixed at a rate of 62.4 ml/min. After stirring for 2 minutes, 203 ml of an aqueous solution of gelatin (containing 1.3 g of gelatin-1, 13 g of NaCl, and an NaOH 1 N solution to adjust pH to 5.5) was added to the reaction mixture, pCl was adjusted to 1.8, the temperature was raised to 75° C., after pCl was set at 1.8, ripening was carried out for 10 minutes. Subsequently, Ag-3 solution (containing 50 ml of 100% $AgNO_3$ in 100 ml of Ag-3 solution) and X-3 solution (containing 23.5 g of NaCl and 71.4 g of KBr in 100 ml of X-3 solution) were added to the reaction mixture at the addition rate of silver nitrate of $2.68\times10^{-2}$ mol/min. and pCl=1.8 by a controlled double jet method for 20 minutes.

Ripening was carried out for 10 minutes after termination of the addition, then a precipitant was added, the temperature was reduced to 35° C., the precipitate was washed with water, an aqueous solution of gelatin was added, and pH was adjusted to 6.0 at 60° C. Transmission type electron microphotographic image (hereinafter referred to as TEM) of the replica of the grains were observed. The emulsion obtained was high silver chloride {100} tabular grains containing about 53 mol % of AgBr based on the silver. The characteristic values of the shape of the grains were as follows:

(entire projected area of tabular grains having aspect ratio greater than 1/sum of projected area of all AgX grains)×100=$a_1$=90%

(average aspect ratio (average diameter/average thickness) of tabular grains)=$a_2$=9.3

(average diameter of tabular grains)=$a_3$=1.67 μm (average thickness)=$a_4$=0.18 μm Preparation of {111} AgBrCl Tabular Emulsion G In the preparation of tabular grain Emulsion E, when grain growth was conducted by a controlled double jet method while maintaining pAg at 8.5, a solution of potassium bromide was changed to a mixed solution of potassium bromide and potassium chloride, silver chlorobromide tabular Emulsions G1 and G2 having the silver iodide content of 17% and 24%, respectively, and having {111} face as main planes were prepared in such a manner that the grain shapes such as the aspect ratio and the grain size became almost the same as those of tabular grain Emulsion E. During the grain growth, Disulfide Compound-B was added in an amount of $1\times10^{-4}$ Mol per mol of the silver halide.

Disulfide Compound-B

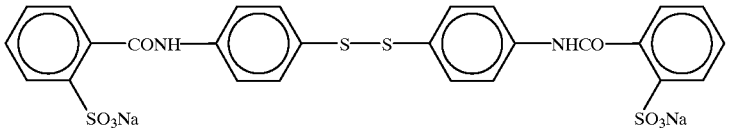

Other conditions were the same as those of tabular Emulsion E.

Preparation of Monodisperse Cubic Silver Halide Emulsion H 32 g of gelatin was dissolved in 1 liter of water in a vessel heated to 53° C., then 0.3 g of potassium bromide, 5 g of sodium chloride and 46 mg of Compound (I) shown below were added thereto, then 444 ml of an aqueous solution containing 80 g of silver nitrate, 452 ml of an aqueous solution containing 45 g of potassium bromide and 5.5 g of sodium chloride were added to the reaction solution by a double jet method over about 20 minutes. Subsequently, 400 ml of an aqueous solution containing 80 g of silver nitrate and 415 ml of an aqueous solution containing 46.4 g of potassium bromide, 5.7 g of sodium chloride and $10^{-7}$ mol/mol of silver of hexachloroiridium(III) acid potassium salt were added thereto by a double jet method over about 25 minutes, and cubic monodisperse silver chlorobromide grains having an average grain size (projected area diameter) of 0.34 $\mu$m (variation coefficient of projected area diameter: 10%) were prepared.

Compound (I)

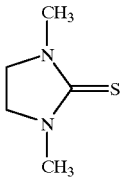

After the emulsion was desalted by coagulation, 62 g of gelatin and 1.75 g of phenoxyethanol were added thereto and pH and pAg were adjusted to 6.5 and 8.5, respectively.

Chemical Sensitization

Each of the above prepared emulsions was chemical sensitized with stirring while maintaining the temperature at 60° C. First of all, $10^{-4}$ mol/mol of silver halide of Thiosulfonic Acid Compound-I was added, then AgBr fine grains having a diameter of 0.10 $\mu$m in an amount of 1.0 mol % based on the entire silver amount, after 5 minutes a 1% solution of KI in an amount of $10^{-3}$ mol per mol of the silver halide, further after 3 minutes $1\times10^{-6}$ mol per mol of Ag of thiourea dioxide were respectively added, and allowed to stand for 22 minutes and reduction sensitization was carried out. Next, 4-hydroxy-6-methyl-1,3,3a,7-tetraazaindene in an amount of $3\times10^{-4}$ mol per mol of Ag, and Sensitizing Dye-1 and Sensitizing Dye-2 were respectively added. Further, calcium chloride was added. Then, $1\times10^{-5}$ mol/mol of Ag of chloroauric acid and $3.0\times10^{-3}$ mol per mol of Ag of potassium thiocyanate were respectively added, subsequently $6\times10^{-6}$ mol per mol of Ag of sodium thiosulfate and $4\times10^{-6}$ mol per mol of Ag of Selenium Compound-I were respectively added, and further, 3 minutes after 0.5 g/mol of Ag of nucleic acid was added. Still further, after 40 minutes water-soluble Mercapto Compound-1 was added and the temperature was reduced to 35° C.

Thus, the preparation (chemical ripening) of the emulsion was completed.

Thiosulfonic Acid Compound-I $C_2H_5SO_2SNa$

Sensitizing Dye-1

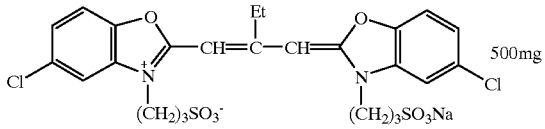

Sensitizing Dye-2

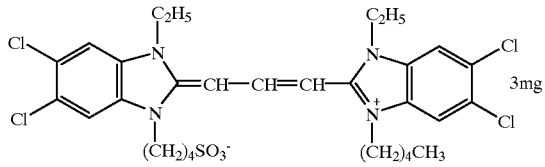

Selenium Compound-I

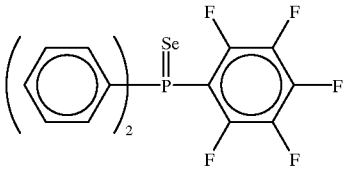

Water-Soluble Mercapto Compound-1

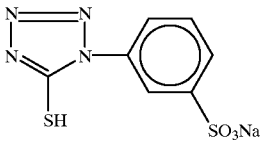

Preparation of Dye Layer

A coating solution for a dye layer was prepared such that the coating amount of each component per one side became the following amount.

| | |
|---|---|
| Gelatin | 0.900 g/m$^2$ |
| Dye Solid Fine Particle Dispersion No. 3 (as dye solid content) | 0.015 g/m$^2$ |

Preparation of Emulsion Coated Layer

The following compounds per mol of the silver halide were added to each of the above chemically sensitized emulsion to prepare an emulsion coating solution.

| | |
|---|---|
| Gelatin (including the gelatin in the emulsion) | 108 g |
| Trimethylolpropane | 9 g |
| Dextran (average molecular weight: 39,000) | 18.5 g |
| Sodium Polystyrenesulfonate (average molecular weight: 600,000) | 1.8 g |
| Hardening Agent, 1,2-Bis(vinylsulfonylacetamido)-ethane (addition amount was adjusted so that the swelling factor reached 230%) | |
| 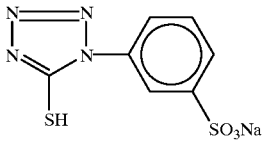 | 20 mg |
| 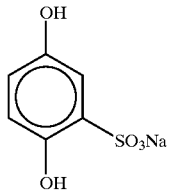 | 4.8 g |

Dye Oil Dispersion L1 used in Example 2 was added to the above coating solution so that the coating weight of Dye D-2 per one side became 10 mg/m$^2$.

Preparation of Coating Solution for Surface Protective Layer

The surface protective layer was prepared so that the coating weight of each composition per one side became as indicated below.

| | |
|---|---|
| Gelatin | 0.900 g/m$^2$ |
| Sodium Polyacrylate (average molecular weight: 400,000) | 0.023 g/m$^2$ |
| 4-Hydroxy-6-methyl-1,3,3a,7-tetraazaindene | 0.015 g/m$^2$ |
| 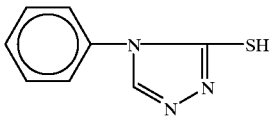 | 30 mg/m$^2$ |
| Proxel (pH was adjusted to 7.4 with NaOH) | 0.0005 g/m$^2$ |
| 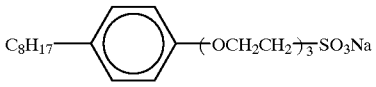 | 0.013 g/m$^2$ |
| 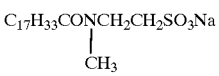 | 0.0065 g/m$^2$ |
| 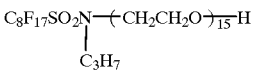 | 0.003 g/m$^2$ |

-continued

| | |
|---|---|
| 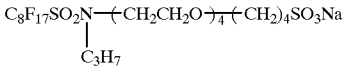 | 0.001 g/m$^2$ |
| 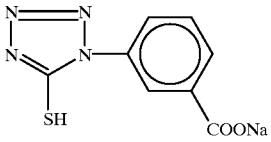 | 15 mg/m$^2$ |

The support was prepared as follows.

Preparation of Support (1) Preparation of Dye Dispersion D-1 for Undercoat Layer The following dye was treated by a ball mill according to the method disclosed in JP-A-63-197943.

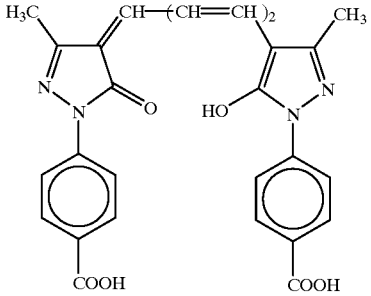

The obtained dye dispersion D-1 was a dye grain dispersion having the average grain size of 0.37 μm. Grains of grain sizes of 1 μm or more were removed by a filter.

(2) Preparation of Support

A biaxially stretched polyethylene terephthalate film having the thickness of 183 μm was corona discharged, and the first undercoat layer having the following composition was coated by a wire bar coater so that the coating amount reached 5.1 ml/m$^2$, and then dried at 175° C. for 1 minute. Then, the first undercoat layer was also coated on the opposite side similarly. The polyethylene terephthalate used contained 0.04 wt % of the dye having the following structure.

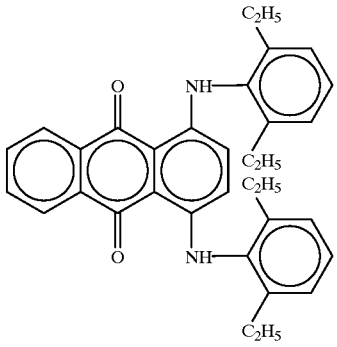

Distilled Water 900.5 ml

* In a latex solution, 0.4 wt %, based on the solid content of the latex, of the following compound was contained as an emulsifying dispersant.

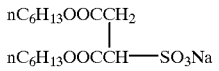

Consequently, the second under coat layer having the following composition was coated by a wire bar coater, and then dried at 170° C. Then, the second undercoat layer was also coated on the opposite side similarly.

| | |
|---|---|
| Gelatin (per one side) | 150 mg/m$^2$ |
| Dye Dispersion D-1 (as dye solid content, per one side) | 25 mg/m$^2$ |
| Matting Agent (polymethyl methacrylate, diameter: 2.5 $\mu$m, per one side) | 2.5 g/m$^2$ |

Preparation of Photographic Material

On both sides of the above prepared support, the dye layer, the emulsion layer and the surface protective layer were coated in order from the support side by a double extrusion method. The coating weight of silver per one side was 1.75 g/m$^2$.

Evaluation of Photographic Capabilities

Each photographic material was subjected to exposure for 0.05 sec. at both sides thereof using X-ray ortho screen HR-4 manufactured by Fuji Photo Film Co., Ltd. After exposure, the following automatic processor and developing solution were used for forming images.

Processing

Automatic processor: CEPPROS-30, manufactured by Fuji Photo Film Co., Ltd.

Preparation of Concentrated Solution

Developing Solution

Part Agent A

| | |
|---|---|
| Potassium Hydroxide | 18.0 g |
| Potassium Sulfite | 30.0 g |
| Sodium Carbonate | 49.6 g |
| Diethylene Glycol | 10.0 g |
| Diethylenetriaminepentaacetic Acid | 2.0 g |
| 1-(N,N-Diethylamino)ethyl-5-mercaptotetrazole | 0.1 g |
| L-Ascorbic Acid | 43.2 g |
| 4-Hydroxymethyl-4-methyl-1-phenyl-3-pyrazolidone | 2.0 g |
| Water to make | 300 ml |
| Part Agent B | |
| Triethylene Glycol | 45.0 g |
| 3,3'-Dithiobishydrocinnamic Acid | 0.2 g |
| Glacial Acetic Acid | 5.0 g |
| 5-Nitroindazole | 0.3 g |
| 1-Phenyl-3-pyrazolidone | 3.5 g |
| Water to make | 60 ml |
| Part Agent C | |
| Glutaraldehyde (50%) | 10.0 g |
| Potassium Bromide | 4.0 g |
| Water to make | 50 ml |

Preparation of Processing Solution 4.5 liters of Part Agent A, 0.90 liters of Part Agent B and 0.75 liters of Part Agent C were filled in CE-DF1 bottle of Fuji Photo film Co., Ltd. for 1.5 liters of working solution and used.

Developing Starter

Acetic acid was added to the above developing replenisher and pH was adjusted to 9.8, this solution was used as a developing starter.

CE-F1 of Fuji Photo Film Co., Ltd. was used as a fixing solution.

Development Conditions

Development temperature: 35° C.

Fixing temperature: 35° C.

Drying temperature: 55° C.

600 Sheets of each sample of film of 10×12 inch size were running processed with the replenishing rate (both developing solution and fixing solution) of 25 ml/10×12 inch size film (325 ml/m$^2$). Good results were obtained.

The evaluation of the photographic materials prepared according to the present invention was conducted in the same manner as in Examples 1 and 2, as a result, it was confirmed that the photographic materials of the present invention are high sensitive, can provide a clear image, are excellent in detectability of a sensor, and do not contaminate processing solutions.

EXAMPLE 4

When Dye Solid Fine Particle Dispersions 3 and 13 or 15 of the present invention were used in the photographic material in Examples 1 and 2 of JP-A-7-152112, high sensitive and clear images were obtained.

EXAMPLE 5

When Dye Solid Fine Particle Dispersions 3 and 11, 12 or 14 of the present invention were used in the photographic material in Examples 1 and 2 of JP-A-7-104430, high sensitive and clear images were obtained.

The photographic material according to the present invention is not only excellent in detectability of a sensor, but is less in reduction of photographic sensitivity. The dye emulsified dispersion of the present invention is a non-dissolving out dispersion and can undergo reduced replenishing rate and rapid processing.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least hydrophilic colloid layers which comprise at least one light-sensitive silver halide emulsion layer and at least one light-insensitive layer, wherein at least one hydrophilic colloid layer contains (i) a high molecular weight compound having a repeating unit represented by formula (I) and (ii) a solid fine particle dispersion of a dye:

(I)

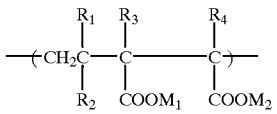

wherein $R_1$ represents a hydrogen atom or an alkyl group; $R_2$ represents a hydrogen atom, an alkyl group or an aryl group;

$R_3$ and $R_4$ each represents a hydrogen atom or an alkyl group; and $M_1$ and $M_2$ each represents a hydrogen atom or a cation, wherein said solid fine particle dispersion of a dye is dispersed using said high molecular weight compound having a repeating unit represented by formula (I)

and wherein said solid fine particle dispersion of a dye is a solid fine particle dispersion of a dye represented by formula (F2):

$$B^2=L_b-B^3(X^-)_{k-1} \quad \text{(F2)}$$

wherein $B^2$ represents a basic nucleus; $B^3$ represents an onium form of a basic nucleus; $L_b$ represents a linking group formed by bonding 5, 7, 9 or 11 methine groups with conjugated double bonds; $X^-$ represents an anion; and k represents 2 or 1, and when the dye forms an inner salt, k represents 1.

2. The silver halide photographic material as claimed in claim 1, wherein, in formula (I), $R_1$ represents a hydrogen atom or an alkyl group having from 1 to 3 carbon atoms; $R_2$ represents a hydrogen atom, an alkyl group having from 1 to 30 carbon atoms or an aryl group having from 6 to 36 carbon atoms; $R_3$ and $R_4$ each represents a hydrogen atom or an alkyl group having from 1 to 3 carbon atoms; and $M_1$ and $M_2$ each represents a hydrogen atom or an alkali metal ion.

3. The silver halide photographic material as claimed in claim 1, wherein said high molecular weight compound having a repeating unit represented by formula (I) is used in an amount of 1 to 100 wt % based on said solid fine particle of dye.

4. The silver halide photographic material as claimed in claim 1, wherein said high molecular weight compound having a repeating unit represented by formula (I) is used in an amount of 5 to 50 wt % based on said solid fine particle of dye.

5. The silver halide photographic material as claimed in claim 1, wherein said solid fine particle of dye is used in an amount of 0.001 to 5 $g/m^2$.

6. The silver halide photographic material as claimed in claim 1, wherein said solid fine particle of dye has an average particle size of 0.005 $\mu$m to 10 $\mu$m.

7. The silver halide photographic material as claimed in claim 1, wherein said solid fine particle of dye has an average particle size of 0.01 $\mu$m to 3 $\mu$m.

* * * * *